US011306970B2

(12) United States Patent
Klaba et al.

(10) Patent No.: US 11,306,970 B2
(45) Date of Patent: Apr. 19, 2022

(54) STACKABLE DRY COOLER ASSEMBLY WITH HEAT EXCHANGER PANELS

(71) Applicant: OVH, Roubaix (FR)

(72) Inventors: Henryk Klaba, Roubaix (FR); Gregory Francis Louis Bauchart, Wattrelos (FR); Ali Chehade, Templeuve (FR); Angelos Lyris, Toulouse (FR)

(73) Assignee: OVH, Roubaix (FR)

( * ) Notice: Subject to any disclaimer, the term of this patent is extended or adjusted under 35 U.S.C. 154(b) by 50 days.

(21) Appl. No.: 16/376,290

(22) Filed: Apr. 5, 2019

(65) Prior Publication Data

US 2019/0310020 A1 Oct. 10, 2019

(30) Foreign Application Priority Data

Apr. 6, 2018 (EP) ..... 18315006

(51) Int. Cl.
*F28F 9/013* (2006.01)
*F28F 9/00* (2006.01)
(Continued)

(52) U.S. Cl.
CPC ..... *F28B 1/06* (2013.01); *E04H 5/12* (2013.01); *F24F 1/54* (2013.01); *F28F 9/001* (2013.01);
(Continued)

(58) Field of Classification Search
CPC ..... F28B 1/06; E04H 5/12; F24F 1/54; F28F 9/001; F28F 9/0131; F28F 9/007; F28F 9/013; F28D 2021/0063; F25B 39/04
(Continued)

(56) References Cited

U.S. PATENT DOCUMENTS 3,727,679 A 4/1973 Von
4,554,796 A 11/1985 Stankard
(Continued)

FOREIGN PATENT DOCUMENTS

CA 2809418 A1 9/2014
CN 101815917 A 8/2010
(Continued)

OTHER PUBLICATIONS

Translation of Japanese Document JP2008202855A entitled Translation-JP2008202855A (Year: 2008).*
(Continued)

*Primary Examiner* — Paul Alvare
(74) *Attorney, Agent, or Firm* — BCF LLP

(57) ABSTRACT

A heat exchanger assembly has a frame including first and second legs laterally spaced apart, a lower transversal member extending laterally and interconnecting the legs, first and second upstanding members laterally spaced apart and extending upwardly from the lower transversal member, an upper transversal member extending laterally and disposed above the lower transversal member and connected to the first and second upstanding members, and first and second upper retaining members laterally spaced apart and being connected to the upper transversal member and extending transversally to the upper transversal member. First and second heat exchanger panels are connected to the first and second upper retaining members. The heat exchanger panels are disposed in a V-configuration such that a distance between upper ends thereof is greater than a distance between lower ends thereof. A fan has a fan rotation axis extending generally parallel to the first and second upstanding members.

14 Claims, 31 Drawing Sheets

(51) Int. Cl.

| | |
|---|---|
| ***E04H 5/12*** | (2006.01) |
| ***F28B 1/06*** | (2006.01) |
| ***F24F 1/54*** | (2011.01) |
| *F28D 21/00* | (2006.01) |

(52) U.S. Cl.
CPC .... *F28F 9/0131* (2013.01); *F28D 2021/0063* (2013.01)

(58) Field of Classification Search
USPC ..... 165/67, 121, 122
See application file for complete search history.

(56) References Cited

U.S. PATENT DOCUMENTS

| | | | | |
|---|---|---|---|---|
| 5,370,178 | A | 12/1994 | Agonafer et al. | |
| 6,151,210 | A | 11/2000 | Cercioglu et al. | |
| 6,225,705 | B1 | 5/2001 | Nakamats | |
| 7,154,748 | B2 | 12/2006 | Yamada | |
| 7,278,273 | B1 | 10/2007 | Whitted et al. | |
| 7,365,977 | B2 | 4/2008 | Fujiya et al. | |
| 7,430,118 | B1 | 9/2008 | Noteboom et al. | |
| 7,508,663 | B2 | 3/2009 | Coglitore | |
| 7,658,039 | B2 | 2/2010 | Ziegelman | |
| 7,733,648 | B2 | 6/2010 | Fujiya et al. | |
| 7,961,463 | B2 | 6/2011 | Belady et al. | |
| 8,151,537 | B2 | 4/2012 | Pope | |
| 8,659,895 | B1 | 2/2014 | Carlson et al. | |
| 8,844,220 | B2 | 9/2014 | Boersema | |
| 8,931,227 | B2 | 1/2015 | Keane | |
| 9,335,098 | B2 * | 5/2016 | Pawlick | F28D 1/024 |
| 10,036,563 | B2 * | 7/2018 | Baruch | F24F 7/007 |
| 10,078,353 | B2 | 9/2018 | Klaba | |
| 10,368,467 | B2 | 7/2019 | Gold et al. | |
| 2005/0168945 | A1 | 8/2005 | Coglitore | |
| 2006/0185515 | A1 | 8/2006 | Hirano | |
| 2006/0187636 | A1 | 8/2006 | Fink et al. | |
| 2007/0064391 | A1 | 3/2007 | Lewis et al. | |
| 2008/0239668 | A1 | 10/2008 | Hendrix et al. | |
| 2008/0257639 | A1 | 10/2008 | Yamaguchi et al. | |
| 2009/0046427 | A1 | 2/2009 | Noteboom et al. | |
| 2009/0229194 | A1 | 9/2009 | Armillas | |
| 2009/0251860 | A1 | 10/2009 | Belady et al. | |
| 2010/0027216 | A1 | 2/2010 | Matsushima | |
| 2010/0110626 | A1 | 5/2010 | Schmitt et al. | |
| 2010/0162739 | A1 | 7/2010 | Kopko et al. | |
| 2010/0251629 | A1 | 10/2010 | Clidaras et al. | |
| 2011/0138708 | A1 | 6/2011 | Chazelle et al. | |
| 2011/0168354 | A1 | 7/2011 | De Jong et al. | |
| 2012/0162906 | A1 | 6/2012 | Jai | |
| 2014/0141707 | A1 | 5/2014 | Carlson et al. | |
| 2014/0259966 | A1 | 9/2014 | Totani et al. | |
| 2014/0262147 | A1 | 9/2014 | Pawlick | |
| 2016/0146550 | A1 * | 5/2016 | Martin | F01N 1/00 165/67 |

FOREIGN PATENT DOCUMENTS

| | | | | | |
|---|---|---|---|---|---|
| CN | 204240827 | U | | 4/2015 | |
| CN | 106716036 | A | | 5/2017 | |
| DE | 69817042 | T2 | | 4/2004 | |
| DE | 102007012539 | A1 | | 9/2008 | |
| EP | 2354378 | A1 | | 8/2011 | |
| FR | 2895209 | A1 | | 6/2007 | |
| JP | H07127884 | A | | 5/1995 | |
| JP | 2008202855 | A | * | 9/2008 | F24F 1/68 |
| JP | 2012117778 | A | | 6/2012 | |
| JP | 2012247155 | A | | 12/2012 | |
| JP | 2014048816 | A | | 3/2014 | |
| WO | 2017202730 | A1 | | 11/2017 | |

OTHER PUBLICATIONS

European Search Report with regard to the counterpart EP Patent Application 18315006.9 dated Aug. 29, 2018.
European Search Report with regard to the counterpart EP Patent Application 18315005.1 dated Aug. 29, 2018.
English Abstract for JP2012117778 retrieved on Espacenet on Mar. 30, 2019.
English Abstract for JP2012247155 retrieved on Espacenet on Mar. 30, 2019.
English Abstract for JP2014048816 retrieved on Espacenet on Mar. 30, 2019.
English Abstract for DE69817042 retrieved on Espaceneton Mar. 30, 2019.
European Search Report with regard to the counterpart EP Patent Application 17194131.3 completed Feb. 27, 2018.
English Abstract for FR2895209 retrieved on Espacenet on Mar. 30, 2019.
International Search Report of PCT/FR2012/051913, dated Dec. 18, 2012.
International Search Report of PCT/FR2012/051938 dated Oct. 8, 2012.
EPO Communication with regard to the counterpart EP Patent Application EP 18315005.1 dated Mar. 26, 2020.
Office Action with regard to the counterpart CN Patent Application No. 201910272165.7 dated Jun. 2, 2021.
English Abstract for CN 106716036 retrieved on Espacenet on Jul. 6, 2021.
English Abstract for CN204240827 retrieved on Espacenet on Jul. 6, 2021.
English Abstract for DE102007012539 retrieved on Espacenet on Jul. 6, 2021.
English Abstract for CN101815917 retrieved on Espacenet on Jul. 6, 2021.
Notice of Allowance with regard to the counterpart U.S. Appl. No. 16/376,303 dated Aug. 23, 2021.
Office Action with regard to the counterpart CN Patent Applicaion No. 201910272165.7 dated Jan. 26, 2022.
English Abstract for JPH07127884 retrieved on Espacenet on Feb. 11, 2022.

* cited by examiner

STACKABLE DRY COOLER ASSEMBLY WITH HEAT EXCHANGER PANELS

CROSS-REFERENCE

The present application claims priority to European Patent Application 18315006.9, filed Apr. 6, 2018, which is incorporated herein by reference.

FIELD OF TECHNOLOGY

The present technology relates generally to heat exchanger assemblies such as dry cooler assemblies.

BACKGROUND

Buildings are often equipped with heat management systems to regulate heat within the building. In certain types of buildings, heat management may be a particularly crucial consideration due to the intended use of the building. For instance, data centers, which store an extensive amount of heat-generating electronic equipment, typically implement a sizable heat management system to evacuate heat from the data center.

For example, data centers often have a dry cooler arrangement installed on the roof of the building that houses the data center. As shown in FIG. 1, an exemplary conventional dry cooler arrangement 100' includes a plurality of dry coolers 10' installed on a roof 102 of a building 104. As will be noted, the conventional dry cooler arrangement 100' occupies a significant surface area of the roof 102, thus limiting the space available for other structures. Moreover, in some cases, central ones of the dry coolers 10' (surrounded by peripheral ones of the dry coolers 10') may recycle hot air rejected by the surrounding dry coolers 10' thus decreasing the efficiency of the heat exchange performed by the cooler arrangement 100'.

Furthermore, conventional dry coolers can be heavy and expensive to produce due to the numerous components that make up the dry cooler. In addition, dry cooler maintenance can be complicated and time-consuming.

Thus there is a desire for a cooling assembly and a dry cooler that alleviates at least in part some of these drawbacks.

SUMMARY

It is an object of the present technology to ameliorate at least some of the inconveniences present in the prior art.

According to one aspect of the present technology, there is provided a heat exchanger assembly. The heat exchanger assembly has a frame including: a first leg and a second leg laterally spaced apart from the first leg; a lower transversal member extending laterally and interconnecting the first and second legs; a first upstanding member and a second upstanding member laterally spaced apart from the first upstanding member, the first and second upstanding members extending upwardly from the lower transversal member; an upper transversal member extending laterally and disposed above the lower transversal member, the upper transversal member being connected to the first and second upstanding members; and a first upper retaining member and a second upper retaining member laterally spaced apart from the first upper retaining member, the first and second upper retaining members being connected to the upper transversal member and extending transversally to the upper transversal member. The heat exchanger assembly also has a plurality of side panels connected to the frame to partially define an enclosed space of the heat exchanger assembly. The heat exchanger assembly also has first and second heat exchanger panels for exchanging heat with air pulled into the heat exchanger assembly. Each of the first and second heat exchanger panels extends from an upper end to a lower end and includes a tubing arrangement for circulating fluid therein. The upper end of each of the first and second heat exchanger panels is connected to the first and second upper retaining members. The first and second heat exchanger panels e disposed in a V-configuration such that a distance between the upper ends of the first and second heat exchanger panels is greater than a distance between the lower ends of the first and second heat exchanger panels. The heat exchanger assembly also has a fan for pulling air into the heat exchanger assembly via at least one of the first and second heat exchanger panels. The fan has a fan rotation axis extending generally parallel to the first and second upstanding members of the frame.

In some embodiments, the frame also includes first and second bracing members extending laterally from the first leg to the second leg. The lower ends of the first and second heat exchanger panels are disposed between the first and second bracing members.

In some embodiments, the frame also includes at least first and second angular members located between the first and second legs. Each of the at least first and second angular members is connected to the lower transversal member. Each of the at least first and second angular members has an angular configuration for conforming to an angular shape of the lower ends of the first and second heat exchanger panels. The at least first and second angular members support the lower end of a respective one of the first and second heat exchanger panels.

In some embodiments, the frame also includes a third upper retaining member laterally between and spaced apart from the first and second upper retaining members. The third upper retaining member is connected to the upper transversal member and extends transversally to the upper transversal member. The upper end of each of the first and second heat exchanger panels is connected to the third upper retaining member.

In some embodiments, the heat exchanger assembly includes a plurality of wheels affixed to the first and second legs.

In some embodiments, the fan is a first fan and the fan rotation axis is a first fan rotation axis. The heat exchanger assembly includes a second fan having a second fan rotation axis extending parallel to the first fan rotation axis. The first fan is disposed adjacent the upper end of the first heat exchanger panel and the second fan is disposed adjacent the upper end of the second heat exchanger panel.

In some embodiments, the heat exchanger assembly is a dry cooler assembly.

In some embodiments, the first and second upstanding members extend vertically from the lower transversal member.

In some embodiments, the first and second upstanding members are tubular.

In some embodiments, the first and second upstanding members are elongated.

In some embodiments, the upper end of each of the first and second heat exchanger panels is fastened to the first and second upper retaining members.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 2:
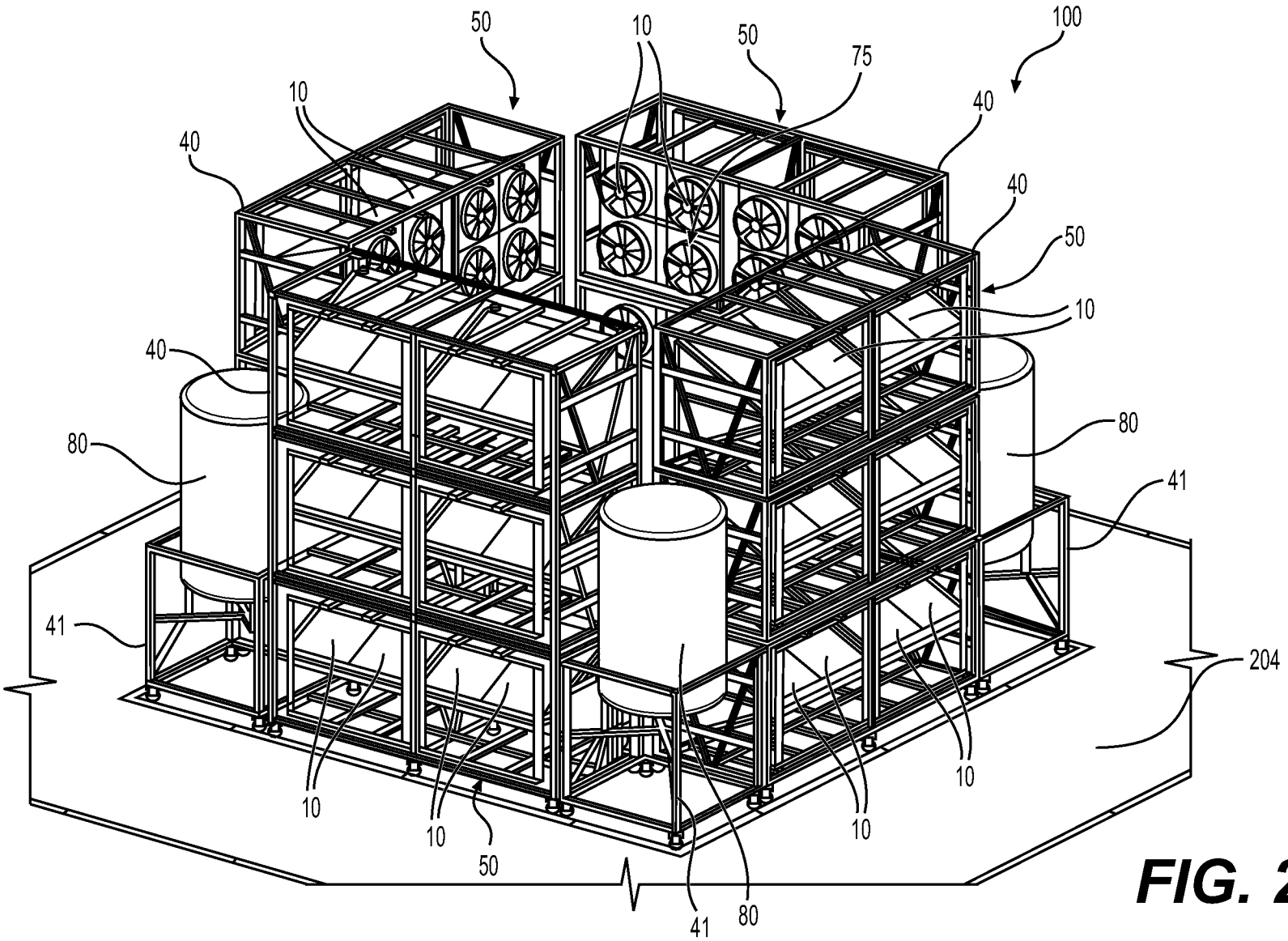
FIG. 2 is a perspective view of a cooling assembly in accordance with an embodiment of the present technology.
Figure 3:
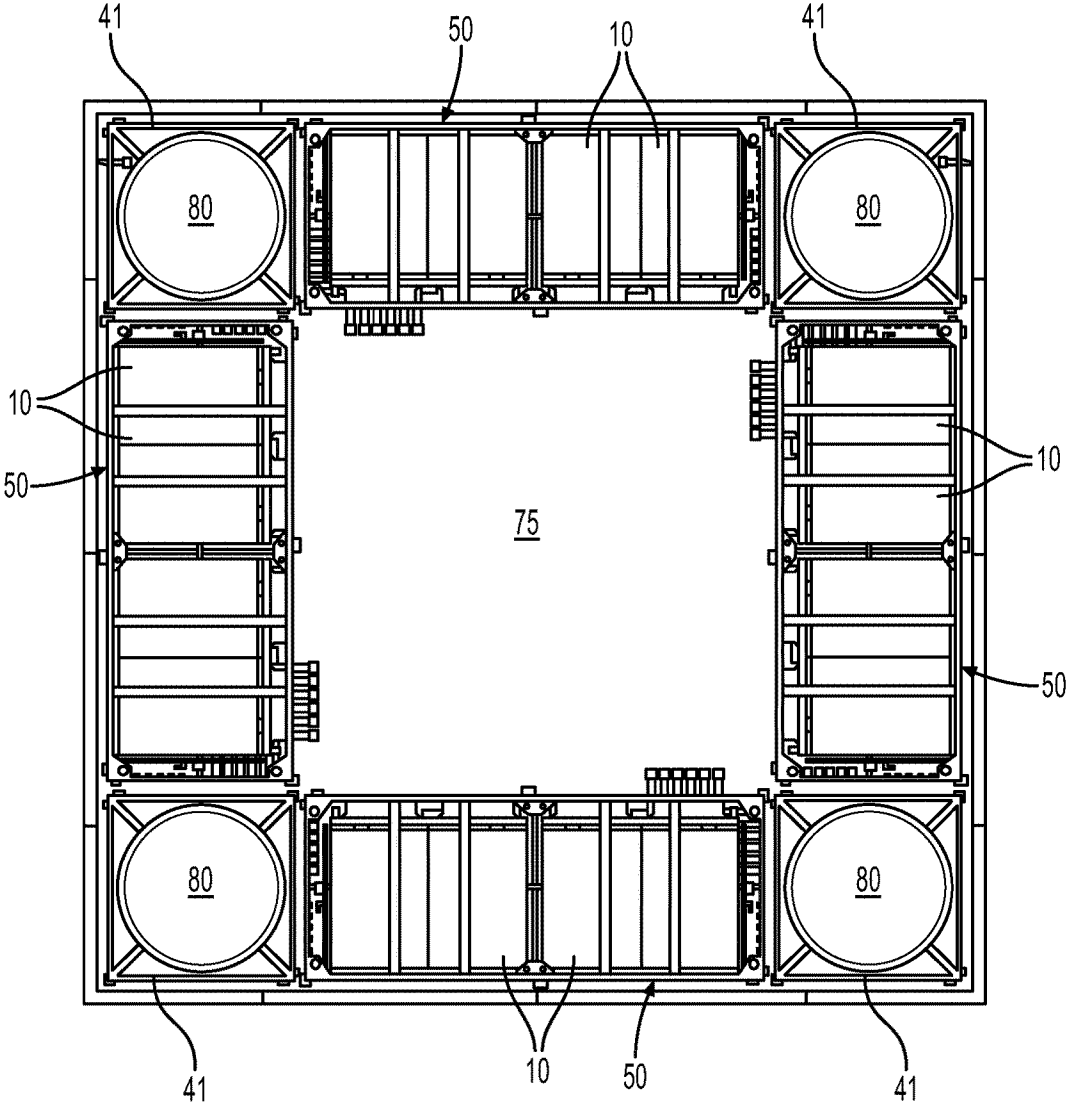
FIG. 3 is a top view of the cooling assembly of FIG. 2.

As shown in FIGS. 2 and 3, a cooling assembly 100 in accordance with an embodiment of the present technology is installed on a support surface 204. In this embodiment, the cooling assembly 100 is part of a larger heat exchange system (not shown) that operates to extract heat (e.g., from inside a building) and reject heat via the cooling assembly 100. To that end, the cooling assembly 100 comprises a plurality of dry coolers 10 for rejecting heat into ambient air.

Figure 16:
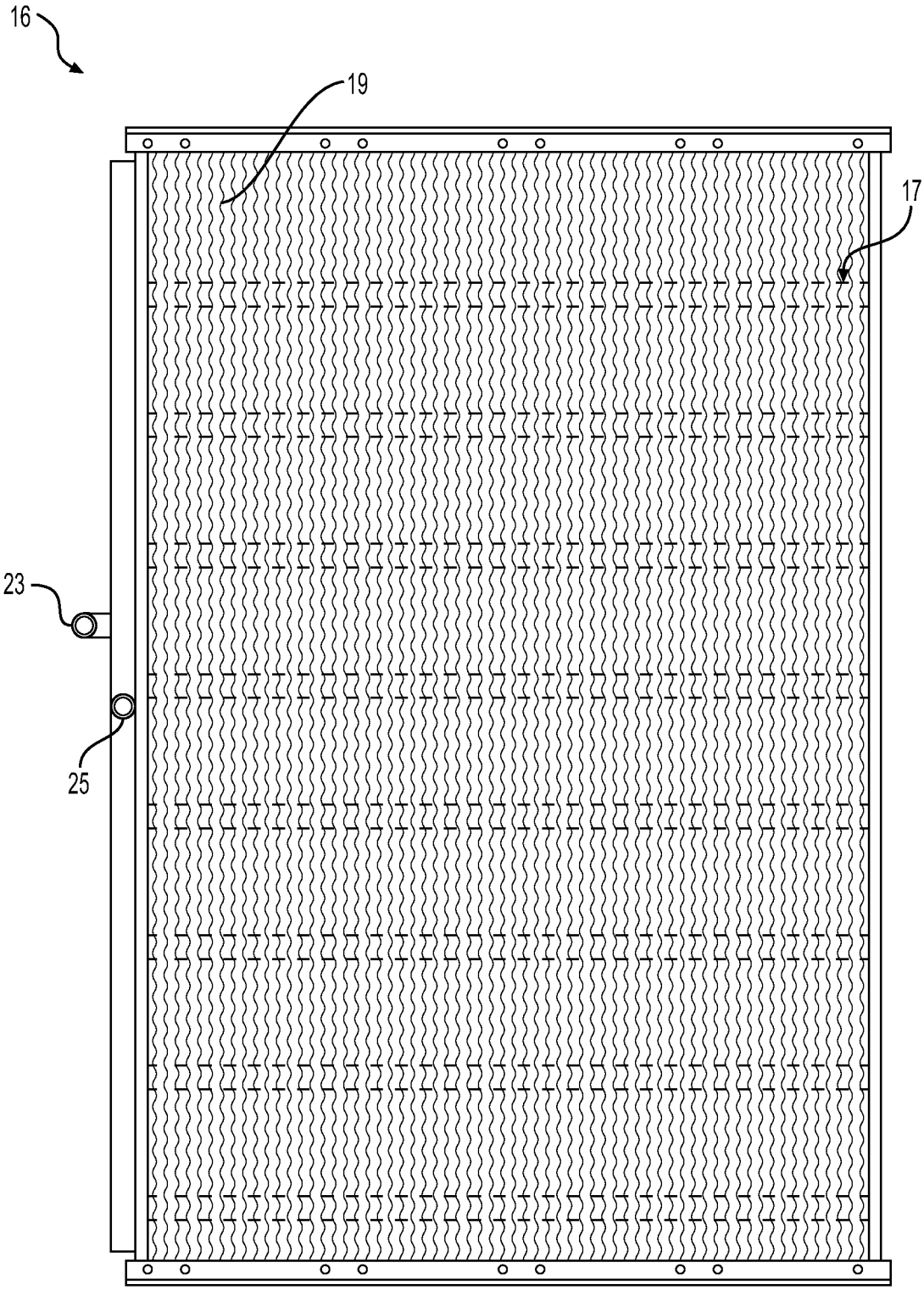
FIG. 16 is a front view of a heat exchanger panel of the dry coolers of FIG. 6.

The configuration of each dry cooler 10 will be described with reference to FIGS. 11, 12 and 14. It is understood that each dry cooler 10 is configured in the same manner. The dry cooler 10 has an air intake 12 for pulling air into the dry cooler 10 and an air outtake 14 for rejecting air out of the dry cooler 10. More specifically, the dry cooler 10 has a heat exchanger panel 16 for exchanging heat with air being pulled into the dry cooler 10 via the air intake 12. In this embodiment, the heat exchanger panel 16 defines the air intake 12 such that air is pulled into the dry cooler 10 via the heat exchanger panel 16. As shown in FIG. 16, the heat exchanger panel 16 includes a tubing arrangement 17 for circulating fluid therein. More specifically, in this example, the fluid circulated in the tubing arrangement 17 is water. It is contemplated that other fluids or additional fluids (e.g., glycol) could circulate within the tubing arrangement 17. The tubing arrangement 17 has a fluid intake 23 through which fluid enters the tubing arrangement 17 and a fluid outtake 25 through which fluid exits the tubing arrangement 17. The tubing arrangement 17 also has a plurality of fins 19 for facilitating heat exchange between fluid circulating in the tubing arrangement 17 and air pulled into the dry cooler 10. The dry cooler 10 also has a fan assembly 15 including a fan 18 and a motor (not shown) for rotating the fan 18. The fan 18 rotates about a fan rotation axis FA to pull air into the dry cooler 10 through the air intake 12 (and thus through the heat exchanger panel 16) and reject heated air out of the dry cooler 10 via the air outtake 14. In this embodiment, the fan 18 defines the air outtake 14 such that heated air is rejected from the dry cooler 10 via the fan 18.

Thus, in use, rotation of the fan 18 causes ambient air to be pulled into the dry cooler 10 via the heat exchanger panel 16. As air is pulled in via the heat exchanger panel 16, heat is transferred from water circulating in the tubing arrangement 17 to the air being pulled into the dry cooler 10 through the heat exchanger panel 16 such that the air is heated while the water discharges heat. Finally, the now heated air is rejected via the fan 18 which pushes out the heated air.

Figure 1:
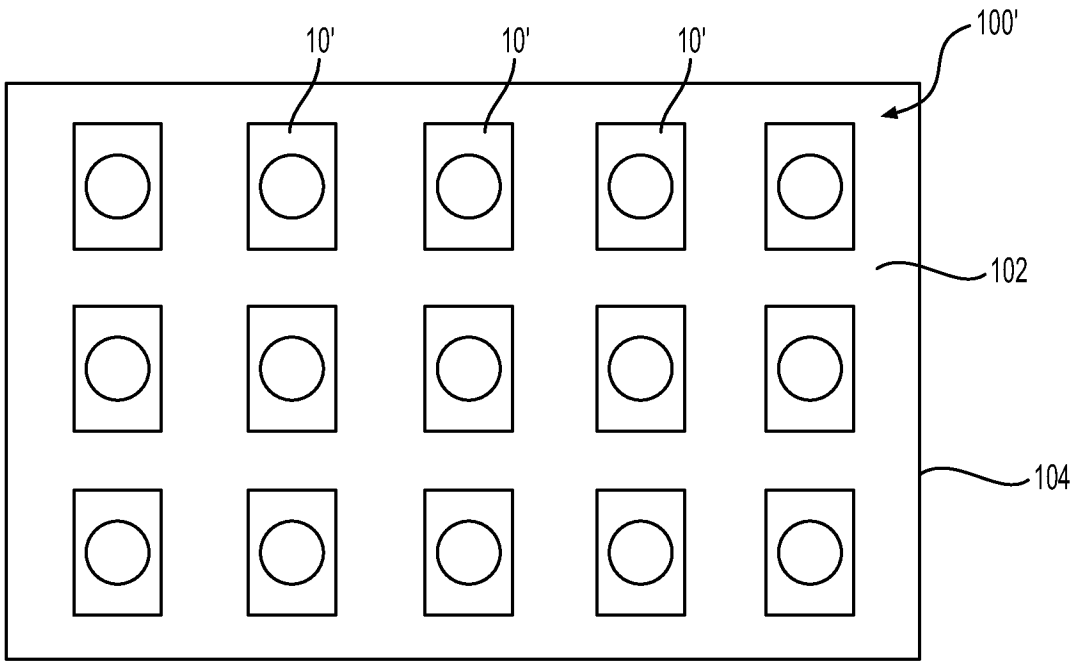
FIG. 1 (PRIOR ART)
FIG. 1 is a top view of a roof of a building having a conventional dry cooler arrangement installed thereon.

As shown in FIG. 2, the dry coolers 10 are arranged in a plurality of dry cooler stacks 50 with each dry cooler stack 50 including respective ones of the dry coolers 10 disposed above one another. As such, together, the dry cooler stacks 50 form a tower and the cooling assembly 100 may thus be referred to as a cooling tower. As will be noted, the dry coolers 10 of each dry cooler stack 50 are oriented transversally such that the fan rotation axis FA of each dry cooler 10 is generally horizontal or otherwise substantially transversal to a vertical axis VA (FIG. 11). That is, in this example, the fan rotation axis FA is oriented at an angle of 90° relative to the vertical axis VA. The fan rotation axis FA may be oriented at other angles relative to the vertical axis VA in other examples. For instance, in some cases, the fan rotation axis FA may be oriented at an angle between 90° and 80°° relative to the vertical axis VA, in some cases at an angle between 80° and 70°, in some cases at an angle between 70° and 60°, in some cases at an angle between 60° and 45° and in some cases even less. This configuration of the cooling assembly 100 may allow a more efficient use of space. For instance, in embodiments where the support surface 204 is part of a roof of a building, implementing the dry cooler stacks 50 may allow a more efficient use of the surface area of the roof since the available vertical space is exploited such that the cooling assembly 100 occupies a smaller surface area of the roof than conventional dry cooler arrangements (see FIG. 1). Moreover, even in alternative embodiments in which the dry cooler stacks 50 are located besides the building from which heat is to be extracted, the cooling assembly 100 allows a more efficient use of facility space. In addition, in these alternative embodiments, a structure of the roof of the building may be made lighter as it does not need to support weight of a conventional dry cooler arrangement 100'.

The dry cooler stacks 50 are positioned such that the dry coolers 10 of each dry cooler stack 50 reject heated air into a common heat rejection zone 75. In this embodiment, the dry cooler stacks 50 surround the common heat rejection zone 75 such that the common heat rejection zone 75 is at a center of the dry cooler stacks 50. More specifically, in this example of implementation, the cooling assembly 100 includes four dry cooler stacks 50 which, as best shown in FIG. 3, are arranged in a square pattern (with each dry cooler stack 50 forming a side of the square pattern). It is contemplated that, in alternative embodiments, the cooling assembly 100 could include more or fewer dry cooler stacks 50 and may be arranged in different geometric patterns. For instance, in some alternative embodiments, the dry cooler stacks 50 may not entirely surround the common heat rejection zone 75. For example, the dry cooler stacks 50 could be arranged in a U-shape pattern.

Figure 20:
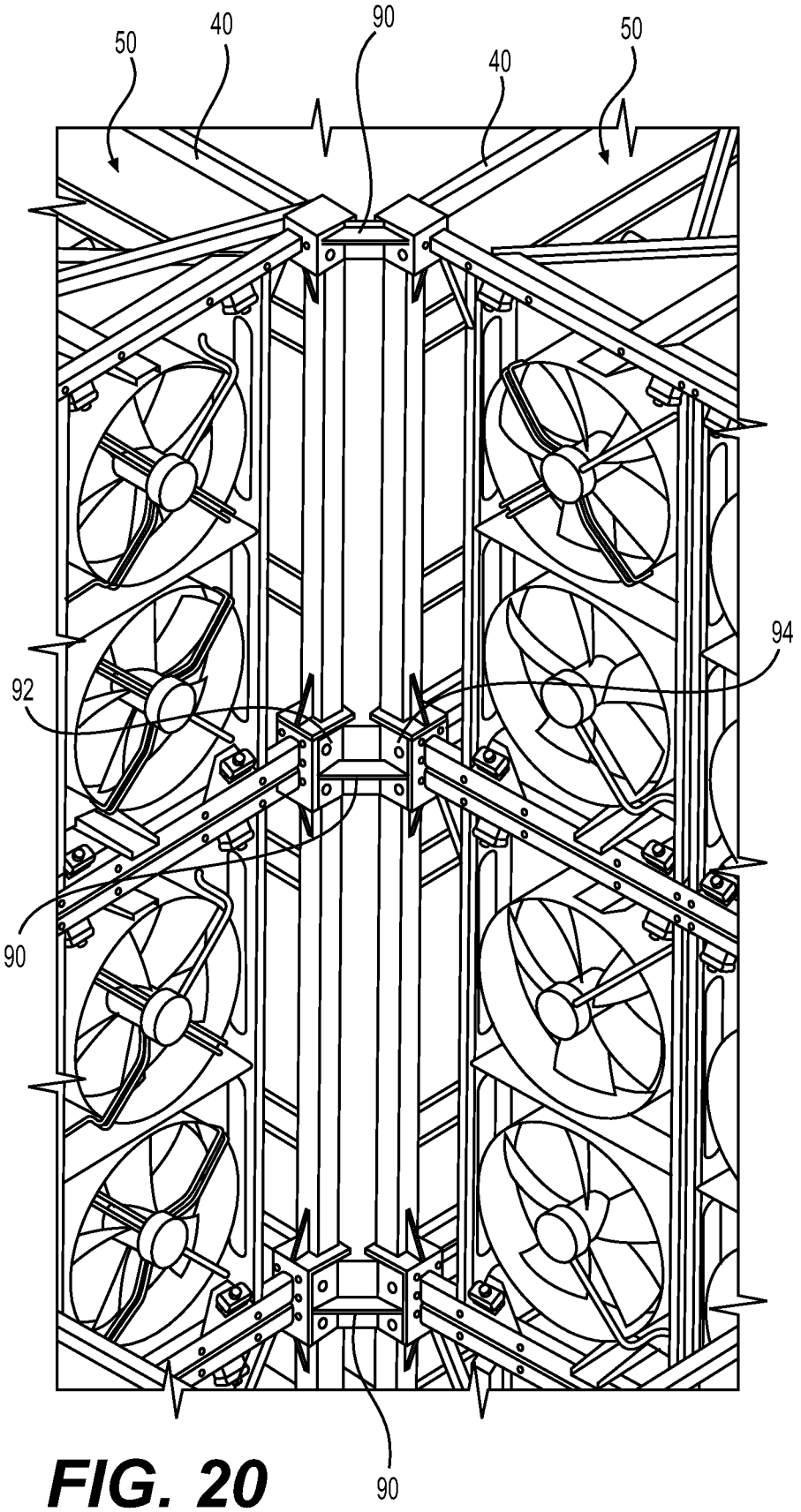
FIG. 20 is a perspective view of part of the cooling assembly of FIG. 2 showing connecting members interconnecting the dry cooler stacks.

Moreover, in this embodiment, as shown in FIG. 20, the dry cooler stacks 50 are interconnected to one another by stack connecting members 90. Notably, as will be described in more detail below, each stack connecting member 90 is fastened (e.g., bolted) to adjacent ones of the dry cooler stacks 50. In this embodiment, since the dry cooler stacks 50 are arranged in a square pattern such that each of the dry cooler stacks 50 is generally perpendicular to an adjacent one of the dry cooler stacks 50, each stack connecting member 90 is angled and has faces 92, 94 that are perpendicular to one another and are fastened to a corresponding one of the dry cooler stacks 50. This may provide additional stability to the cooling assembly 100.

The implementation of the common heat rejection zone 75 allows a heated air column to form at the common heat rejection 75. Since hot air rises, the heated air column rises above the cooling assembly 100 and is thus dissipated into ambient air away from the air intakes 12 of the dry coolers 10. This may help minimize or otherwise prevent the recycling of heated air by the dry coolers 10 and may thus result in improved efficiency over conventional dry cooler arrangements.

The cooling assembly 100 also includes fluid tanks 80 for storing fluid therein. The fluid tanks 80 which, in this embodiment, contain water are supported on frames 41. In this example of implementation, the frames 41 along with the fluid tanks 80 mounted thereon are positioned at corners of the square pattern formed by the dry cooler stacks 50 such that there are four fluid tanks 80. Two of the fluid tanks 80 are in fluid communication with atomizer units (which will be described in more detail below) while the other two fluid tanks 80 are in fluid communication with an air cooling system (not shown) that is independent of the function of the dry coolers 10. To that end, piping is provided for circulating fluid (e.g., water) therein and routing the fluid from the tanks 80 to the atomizer units and the air cooling system. The frames 41 may be structurally linked to the dry cooler stacks 50 to provide additional stability to the cooling assembly 100.

Figure 8:
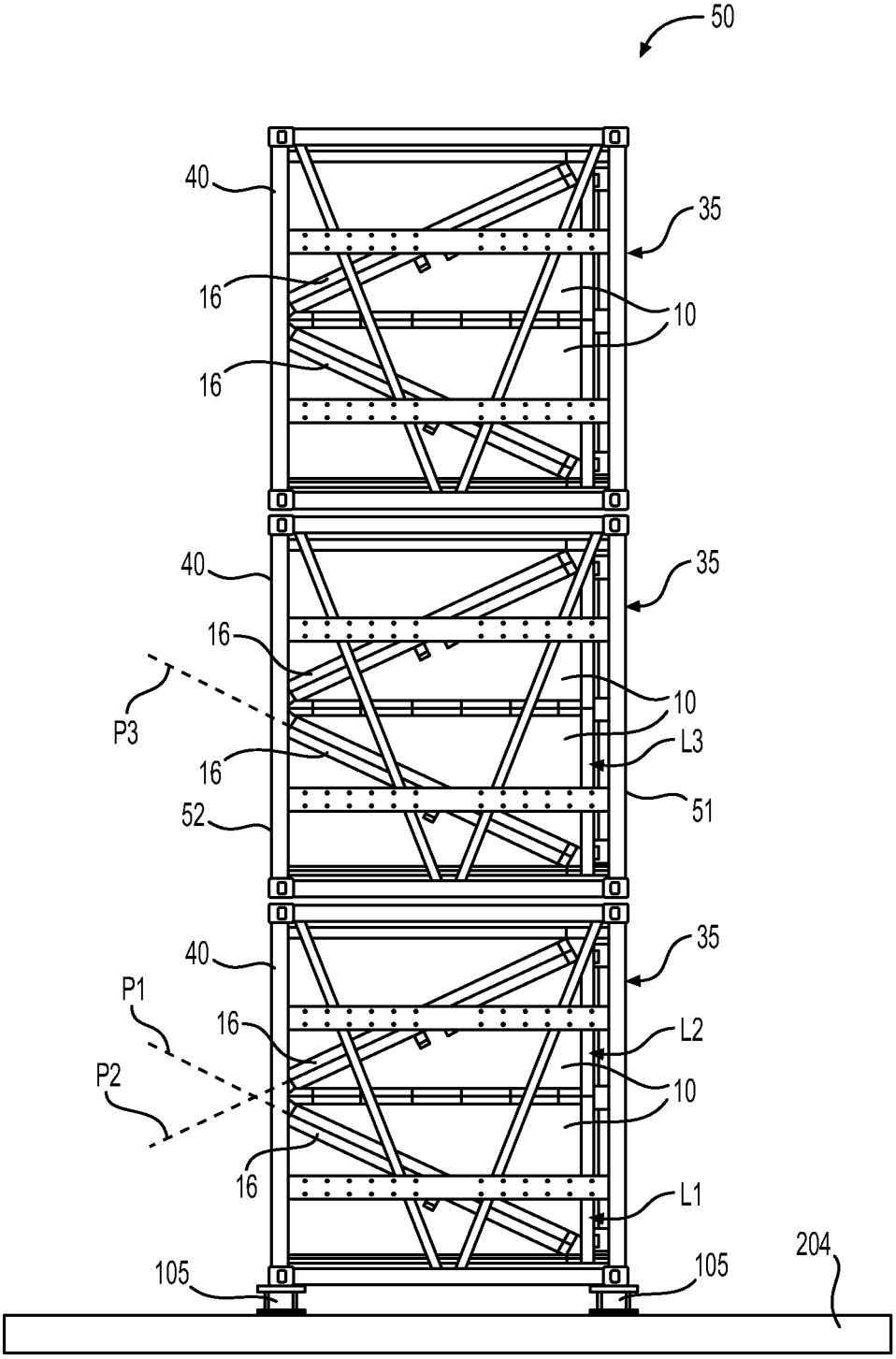

As shown in FIG. 8, each dry cooler stack 50 has a plurality of levels LN, with each level LN including at least one of the dry coolers 10. In this embodiment, each of the dry cooler stacks 50 includes six levels LN of dry coolers 10 and each level LN includes four dry coolers 10. It is contemplated that the dry cooler stacks 50 could include more or fewer levels and that each level could include more or fewer dry coolers. A first level L1 of the plurality of levels LN is closest to the support surface 204 onto which the cooling assembly 100 is installed and a second level L2 of the plurality of levels LN is atop the first level L1. In this embodiment, as will be described in more detail further below, the dry coolers 10 of the second level L2 are stacked atop corresponding ones of the dry coolers 10 of the first level L1.

In this embodiment, as shown in FIG. 8, the heat exchanger panels 16 of the dry coolers 10 in the first level L1 are oriented at an angle relative to the heat exchanger panels 16 of the dry coolers 10 in the second level L2. More specifically, the heat exchanger panel 16 of each of the dry coolers 10 in the first level L1 extends along a plane P1 while the heat exchanger panel 16 of each of the dry coolers 10 in the second level L2 extends along a plane P2 that is transversal to the plane P1. This orientation of the heat exchanger panels 16 of the dry coolers 10 of the first and second levels L1, L2 results in a V-configuration of the heat exchanger panels 16 of the dry coolers 10 of the first level L1 with the heat exchanger panels 16 of the dry coolers 10 of the second level L2. As such, the heat exchanger panels 16 of the dry coolers 10 of the first and second levels L1, L2 are oriented to converge toward one another at a front end 52 of the dry cooler stack 50 which is further from the common heat rejection zone 75 than an opposite rear end 51 of the dry cooler stack 50.

Furthermore, in this embodiment, the heat exchanger panel 16 of each of the dry coolers 10 in a third level L3 of each dry cooler stack 50, above the second level L2, extends along a plane P3 (FIG. 8) that is parallel to the plane P1 of the heat exchanger panel 16 of each of the dry coolers 10 in the first level L1.

Figure 5:
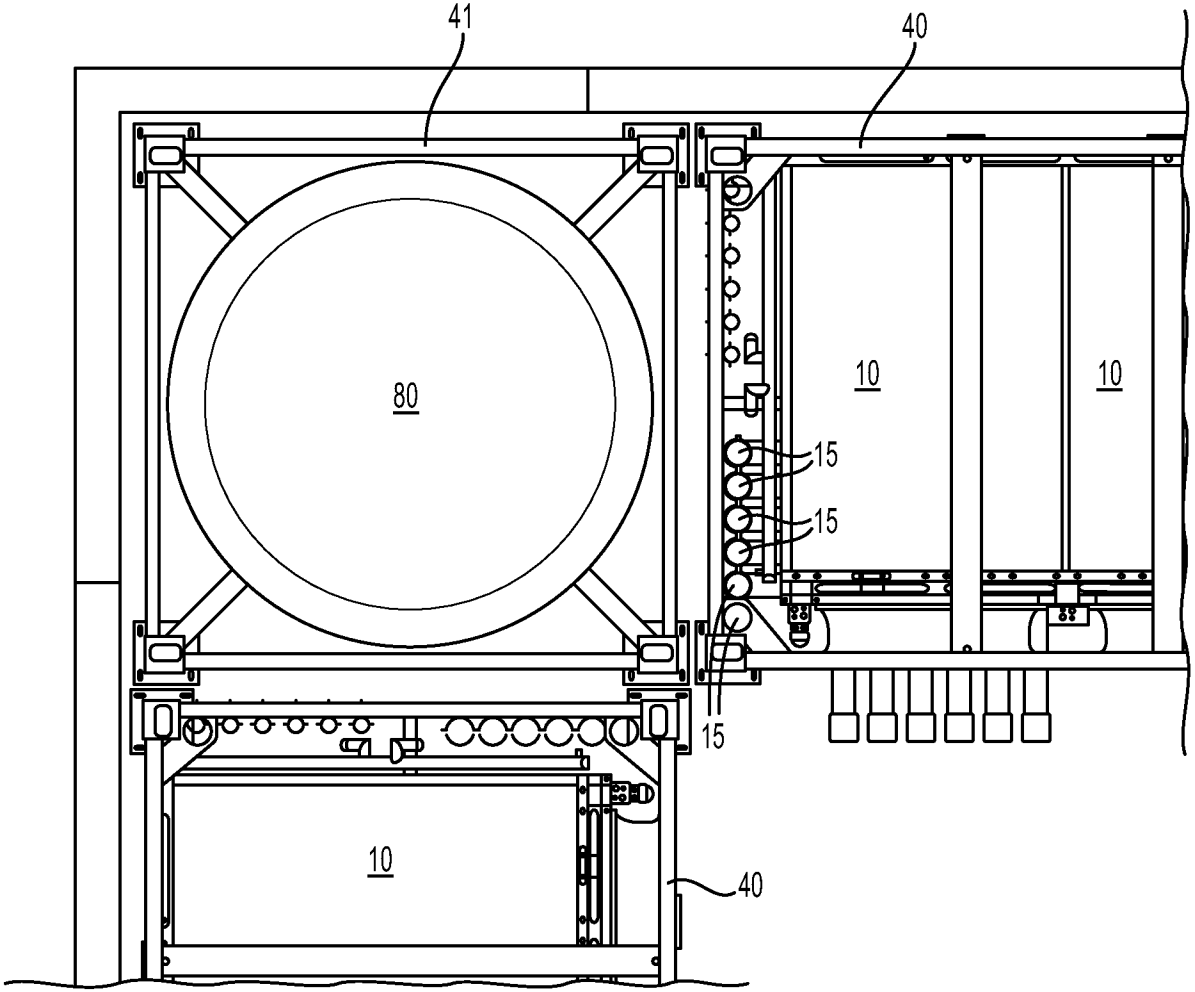
FIG. 5 is a top view of part of the cooling assembly of FIG. 2.
Figure 6:
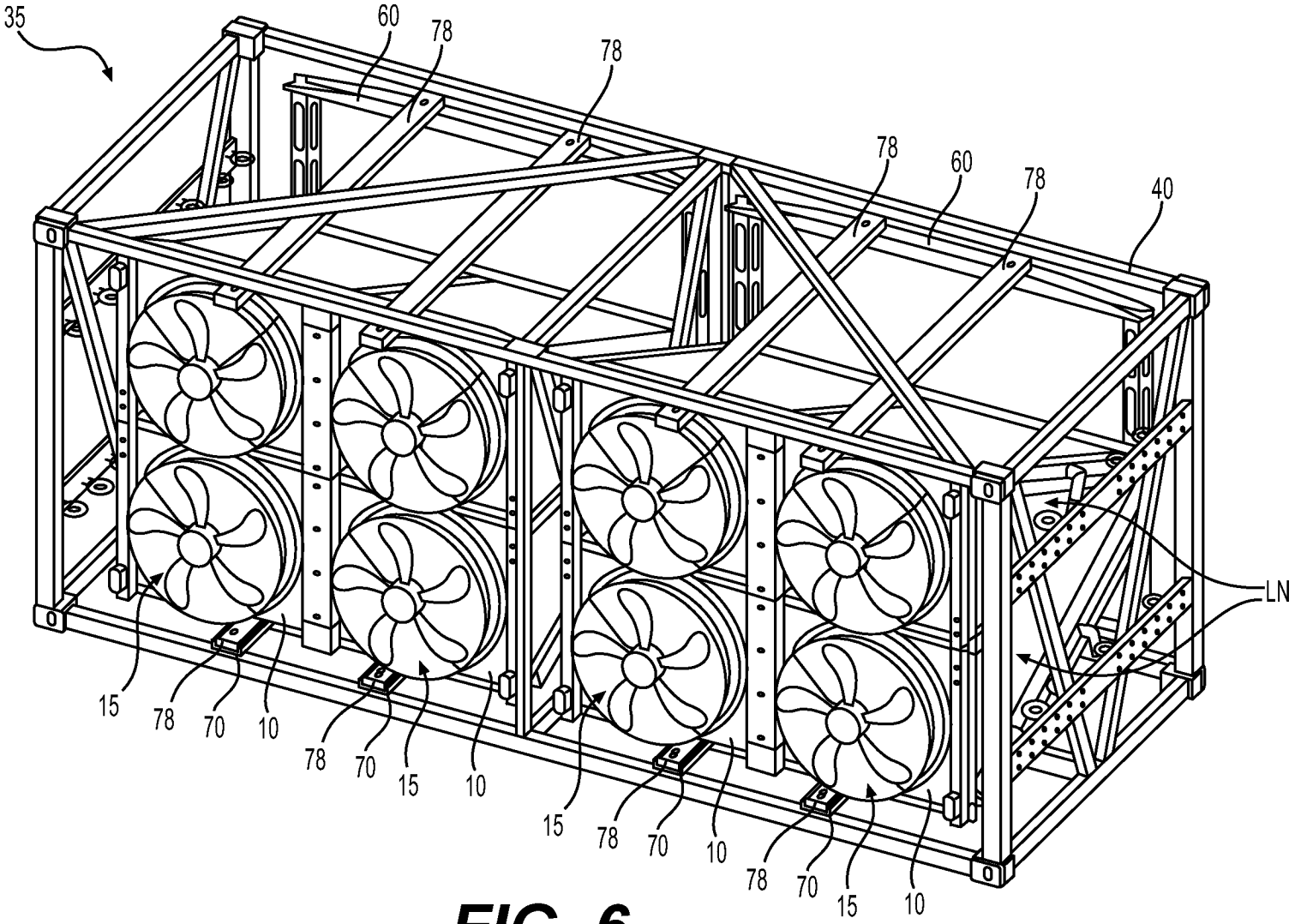
FIG. 6 is a perspective view of a stackable unit of a dry cooler stack of the cooling assembly of FIG. 2 including two levels of dry coolers of the dry cooler stack.

Fluid to be circulated through the heat exchanger panels 16 of the dry coolers 10 is routed to and from the heat exchanger panels 16 via piping 15 (FIG. 5). That is, selected conduits of the piping 15 carry fluid to be cooled from a fluid source inside the building 104 to the fluid intakes 23 of the heat exchanger panels 16 of the dry coolers 10 while other selected conduits of the piping 15 carry fluid that has been cooled from the fluid outtakes 25 of the heat exchanger panels 16 of the dry coolers 10 to be recirculated inside the building 104.

In this embodiment, each dry cooler stack 50 includes a plurality of stackable units 35 which are stackable atop one another to form the dry cooler stack 50. Each stackable unit 35 includes two levels LN of the dry coolers 10 (i.e., a lower row of dry coolers 10 and an upper row of dry coolers 10). More specifically, as will be described in more detail below, each stackable unit 35 includes a main frame 40 and two dry cooler assemblies 60 (each including four of the dry coolers 10) mounted to the main frame 40.

Figure 9:
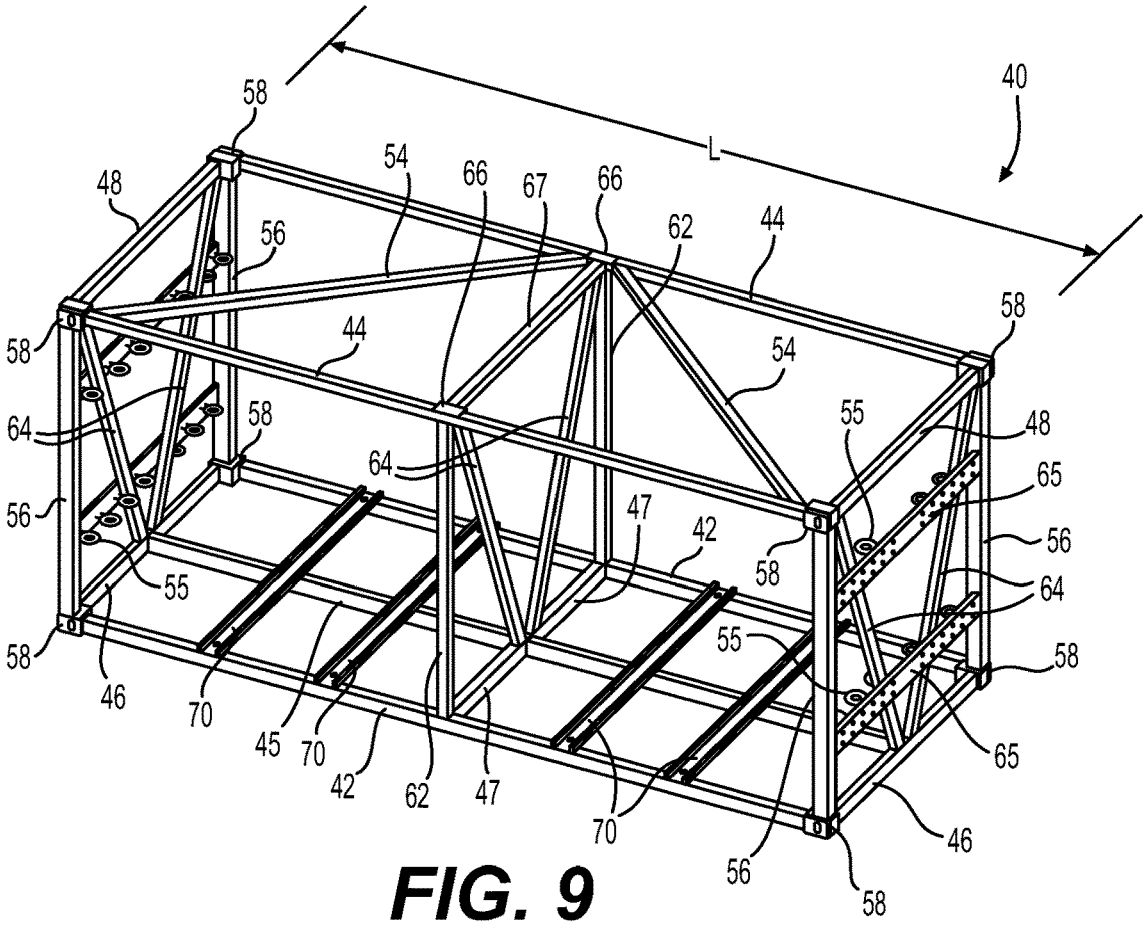
FIG. 9 is a perspective view of a frame of the stackable unit of FIG. 6.

With reference to FIG. 9, the main frame 40 has lower longitudinal members 42 and upper longitudinal members 44 disposed above respective ones of the lower longitudinal members 42. The lower and upper longitudinal members 42, 44 are parallel to one another. Lower end members 46 extend between the ends of the lower longitudinal members 42 while upper end members 48 extend between the ends of the upper longitudinal members 44. The lower and upper end members 46, 48 extend perpendicularly to the lower and upper longitudinal members 42, 44. Four corner vertical members 56 extend between and interconnect the lower and upper longitudinal members 42, 44. More specifically, corner members 58 are provided at each corner of the main frame 40 to interconnect one of the corner vertical members 56 with one of the lower or upper longitudinal members 42, 44 and one of the lower or upper end members 46, 48. To that end, in this example of implementation, the corner members 58 have openings for inserting a respective one of the corner vertical members 56, the lower or upper longitudinal members 42, 44 and the lower or upper end members 46, 48 of the main frame 40. The corner members 58 may be press fit or otherwise fastened (e.g., welded) to the corner vertical members 56, the lower or upper longitudinal members 42, 44 and the lower or upper end members 46, 48 of the main frame 40.

Middle vertical members 62 extend vertically and are spaced equidistantly from longitudinally opposite ones of the corner vertical members 56. The middle vertical members 62 interconnect respective ones of the lower and upper longitudinal members 42, 44 at a midlength (i.e., half the length) thereof. Plate connectors 66 are provided at the junctions between a respective one of the middle vertical members 62, an upper middle member 67 (parallel to the upper end members 48 and interconnecting the upper longitudinal members 44) and the upper longitudinal members 44. In this example, upper diagonal members 54 extend from one of the corner members 58 to a given one of the junctions between a respective one of the middle vertical members 62, the upper middle member 67 and the upper longitudinal members 44.

A middle lower longitudinal member 45, parallel to the lower longitudinal members 42, extends between and interconnects the opposite lower end members 46 at a midlength thereof. Two lower middle members 47, parallel to the lower end members 46, extend transversally to the middle lower longitudinal member 45 and interconnect the middle lower longitudinal member 45 to respective ones of the lower longitudinal members 42. Upwardly extending diagonal members 64 interconnect the middle lower longitudinal member 45 with the upper junctions of the main frame 40 (i.e., at the junctions between respective ones of the upper longitudinal members 44 with the corner vertical members 56 as well as with the middle vertical members 62).

Horizontal support members 65 extend transversally to the lower and upper longitudinal members 42, 44 and are secured to a respective pair of the corner vertical members 56. The horizontal support members 65 are provided with clamps 55 for securing the piping 15 to the main frame 40.

The main frame 40 also has connector members 70 that extend from one of the lower longitudinal members 42 to an opposite one of the lower longitudinal members 42. The connector members 70 are affixed to the lower longitudinal members 45 and to the middle lower longitudinal member 45 (e.g., welded thereto). As will be described in more detail below, the connector members 70 are configured for receiving the dry cooler assemblies 60. In this embodiment, each of the connector members 70 is elongated and has a cross-sectional C-shape such that the connector member 70 forms a channel.

The main frame 40, and thus the stackable unit 35, is configured sized to be suitable for transport. As such, in this embodiment, a length L of the main frame 40 (which defines the length of the stackable unit 35) is approximately 20 feet (6.1 meters). The main frame 40 of each stackable unit 35 is thus sized to fit in a standard sized 20-feet container and on a trailer. The length of the stackable unit 35 may be different in other embodiments. For instance, in some embodiments, the length L of the main frame 40 (and thus of the stackable unit 35) may be between 15 and 20 feet (4.6 meters and 6.1 meters). The length of the stackable unit 35 may have any other suitable value in other embodiments.

Figure 11:
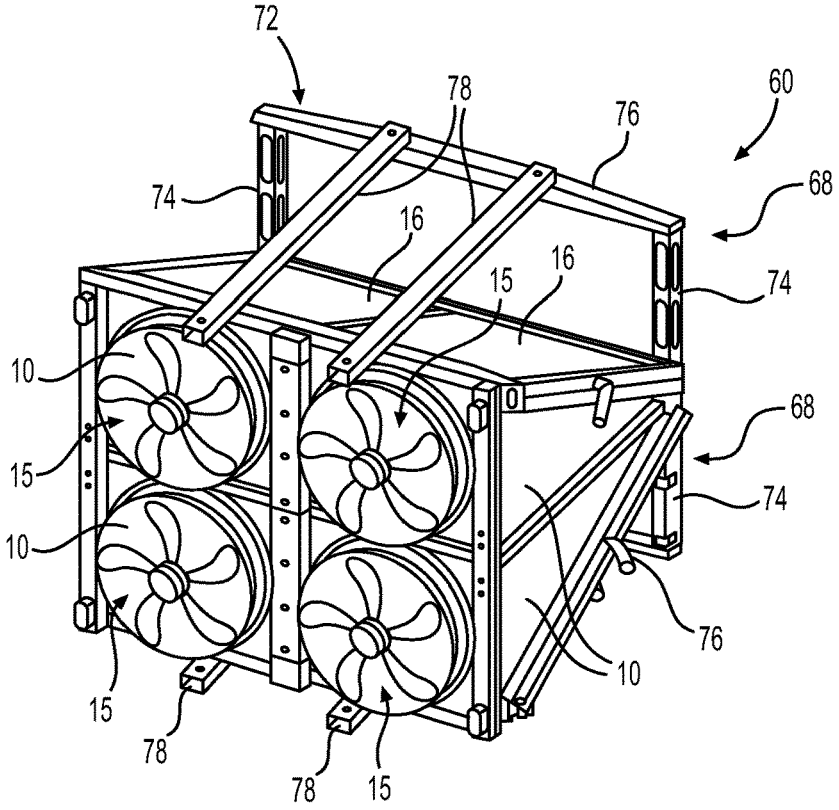
FIG. 11 is a perspective view of a dry cooler assembly of the stackable unit of FIG. 6.
Figure 12:
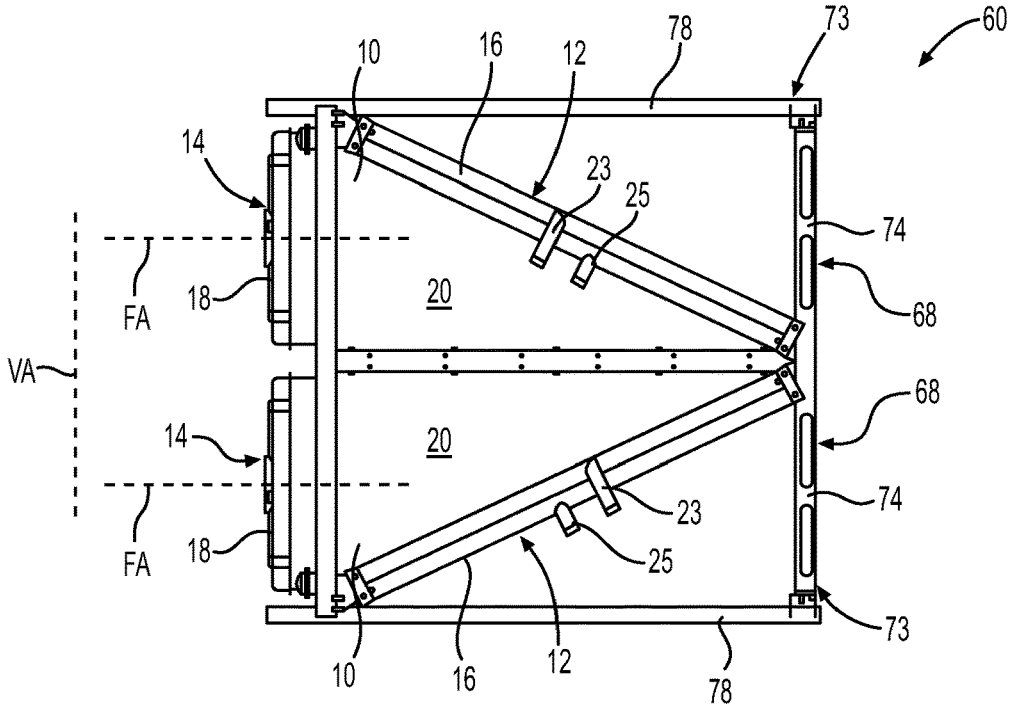
FIG. 12 is a side elevation view of the dry cooler assembly of FIG. 11.
Figure 13:
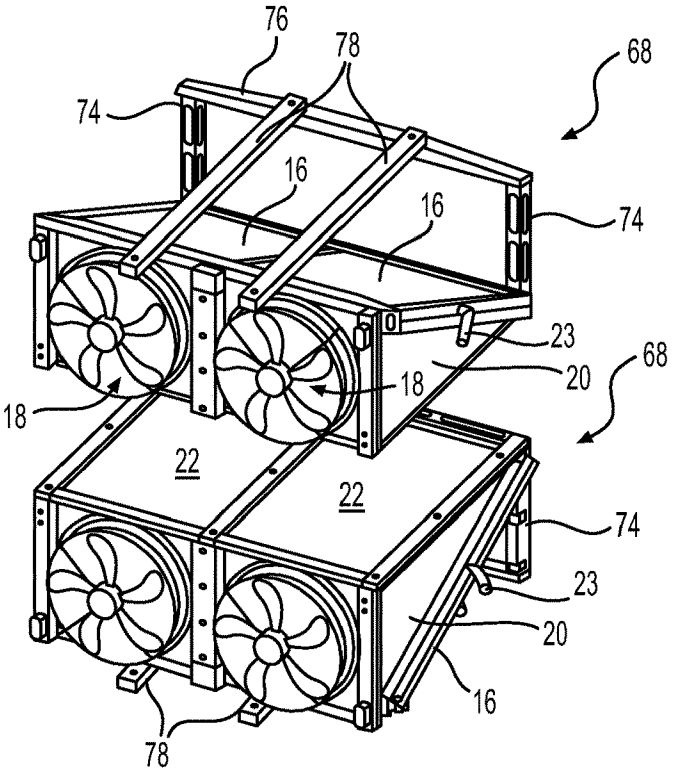
FIG. 13 is a partially exploded view of the dry cooler assembly of FIG. 11 showing discrete modules of the dry cooler assembly of FIG. 10.

With reference to FIG. 11, in this embodiment, each dry cooler assembly 60 has four dry coolers 10, including two lower dry coolers 10 and two upper dry coolers 10. More specifically, as best shown in FIG. 13, in this embodiment, the dry cooler assembly 60 includes two discrete modules 68 that are connected to one another to form the dry cooler assembly 60.

Figure 14:
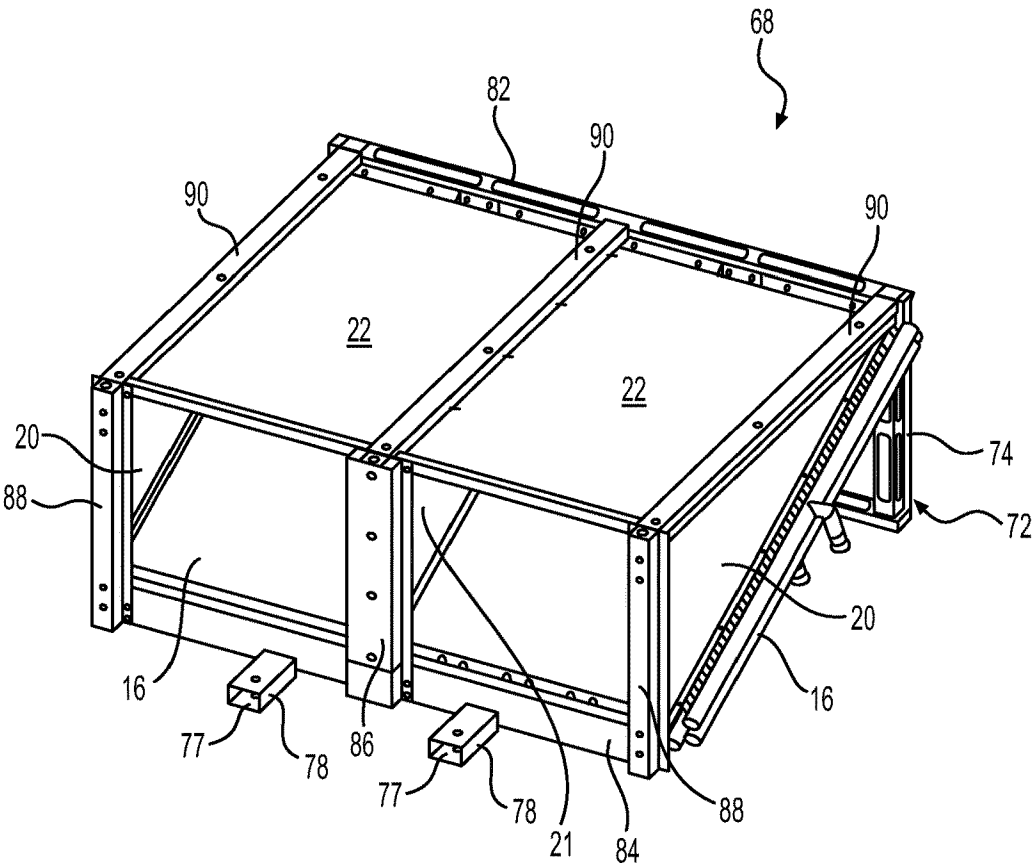
FIG. 14 is a perspective view of part of one of the discrete modules of FIG. 13.
Figure 15:
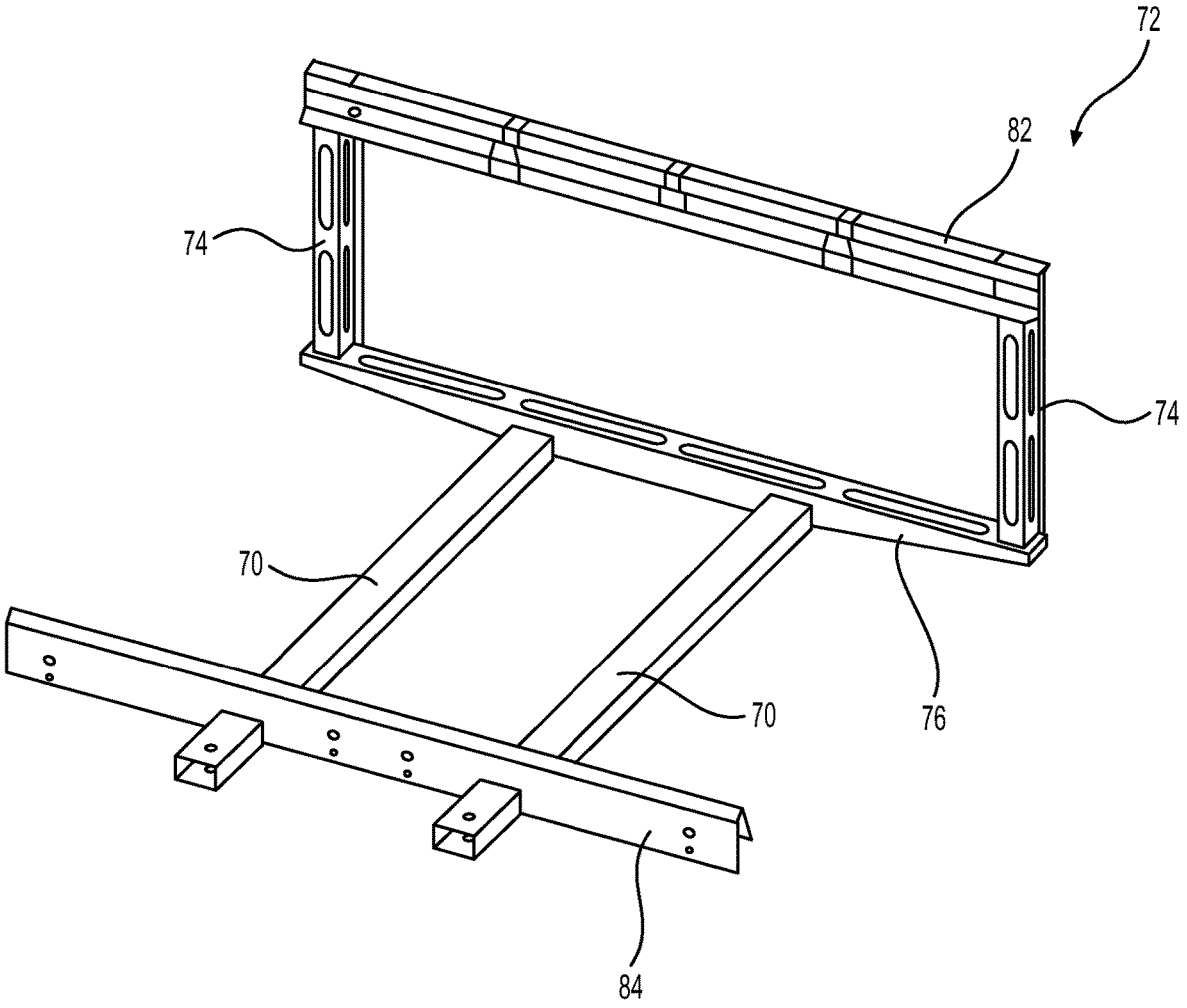
FIG. 15 is a perspective view of a sub-frame of the discrete module of FIG. 14.

FIG. 14 shows part of one of the discrete modules 68, with the fans 18 of each dry cooler 10 removed therefrom to expose an interior portion of the dry cooler 10. As will be noted, each discrete module 68 includes two of the dry coolers 10 and has a sub-frame 72 (best shown in FIG. 15) for supporting the dry coolers 10. With additional reference to FIG. 15, the sub-frame 72 includes two legs 74 extending vertically and transverse members 76, 82 interconnecting the legs 74. The transverse members 76, 82 are parallel to one another and extend transversely to the legs 74. As such, the legs 74 and the transverse members 76, 82 form a rectangular support. The sub-frame 72 also includes an exchanger support member 84 for supporting the heat exchanger panels 16. The exchanger support member 84 extends parallel to the transverse members 76, 82. The sub-frame 72 also includes two lifting members 78 that extend transversely to the exchanger support member 84 (e.g., parallel to the fan rotation axis FA of the dry coolers 10) and are connected thereto. Each of the lifting members 78 defines a cavity 77 for insertion of a lifting implement therein. That is, a lifting implement such as a fork of a forklift is insertable within each cavity 77 to lift the discrete module 68 and/or the dry cooler assembly 60 and/or the stackable unit 35.

As shown in FIG. 14, each of the two dry coolers 10 of the discrete module 68 includes a side panel 20 and a horizontal panel 22 to partially define the interior of the dry cooler 10. Moreover, the two dry coolers 10 share a common middle panel 21 to enclose the interior of the two dry coolers 10 of the discrete module 68. The inclusion of the middle panel 21 may allow each of the fans 18 to have an associated air volume isolated by the panels 20, 21, 22 from the laterally-adjacent one of the fans 18. This may facilitate detecting if one of the laterally-adjacent dry coolers 10 is faulty and requires maintenance. Each of the two dry coolers 10 also includes joint members 90 that extend longitudinally and interconnect the side panels 20 with the horizontal panels 22. The two dry coolers 10 also share a middle one of the joint members 90 that interconnects the horizontal panels 22 and the middle panel 21. Each of the two dry coolers 10 also includes vertical members 88 that interconnect a respective one of the side panels 20 with the exchanger support member 84. Meanwhile, a middle vertical member 86 interconnects the exchanger support member 84 with the middle panel 21. The fans 18 of the two dry coolers 10 (FIG. 13) of the discrete module 68 are thus mounted to the vertical members 86, 88 and separated by the middle vertical member 86.

The dry cooler assemblies 60 are slidably insertable into the main frame 40. That is, once the main frame 40 is assembled, the dry cooler assemblies 60 can be slid into place within the main frame 40. Notably, each of the dry cooler assemblies 60 can be lifted from two adjacent ones of the lifting members 78 and slid into engagement with the main frame 40 such that the lower lifting members 78 of the dry cooler assembly 60 engage the connector members 70. More particularly, the lifting members 78 are received within the channel formed by each of the connector members 70. The dry cooler assembly 60 is then slid within the main frame 40 until the dry cooler assembly 60 is in place. An abutment may be provided on the main frame 40 to define the intended position of the dry cooler assembly 60. The lower lifting members 78 of the dry cooler assembly 60 are then secured to the connector members 70 (e.g., bolted thereto).

In order to install the cooling assembly 100 on the support surface 204, first, the bottommost stackable unit 35 of each of the dry cooler stacks 50 is affixed to the support surface 204. To that end, in this embodiment, with reference to FIGS. 7 and 8, a plurality of anchoring members 105, 106 are provided for affixing the main frame 40 of each of the bottommost stackable unit 35 to the support surface 204. The anchoring members 105, 106 are first affixed to the support surface 204 at designated locations thereof.

Figure 17:
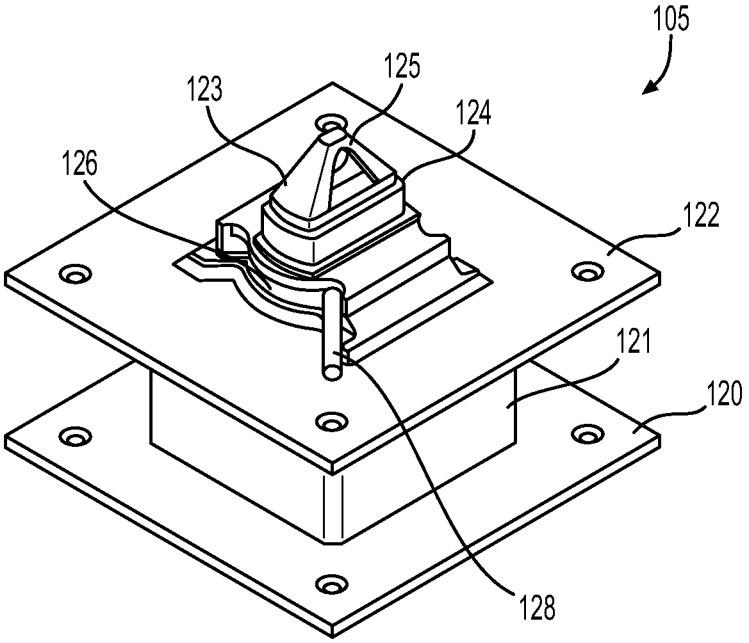
FIGS. 17 and 18 are perspective views of two types of anchors of the cooling assembly of FIG. 2.

With reference to FIG. 17, the anchoring member 105 has lower and upper horizontal flanges 120, 122 spaced apart by a body 121. The upper flange 122 has a securing device 123 for securing the main frame 40 of the bottommost stackable unit 35 to the anchoring member 105. The securing device 123 has a base portion 124 and a top portion 125 disposed above and movable relative to the base portion 124. The securing device 123 also has a selectively movable lever 128 that is movable within a slot 126 of the base portion 124. Moving the lever 128 from one end of the slot 126 to the opposite end of the slot 126 actuates the top portion 125 of the securing device 123. More specifically, the top portion 125 rotates from an unlocked position shown in FIG. 17, in which the top portion 125 is generally aligned with the base portion 124, to a locked position (not shown) in which the top portion 125 is generally perpendicular to the base portion 124. Such securing devices are known and commonly referred to as a "twistlock".

Figure 18:
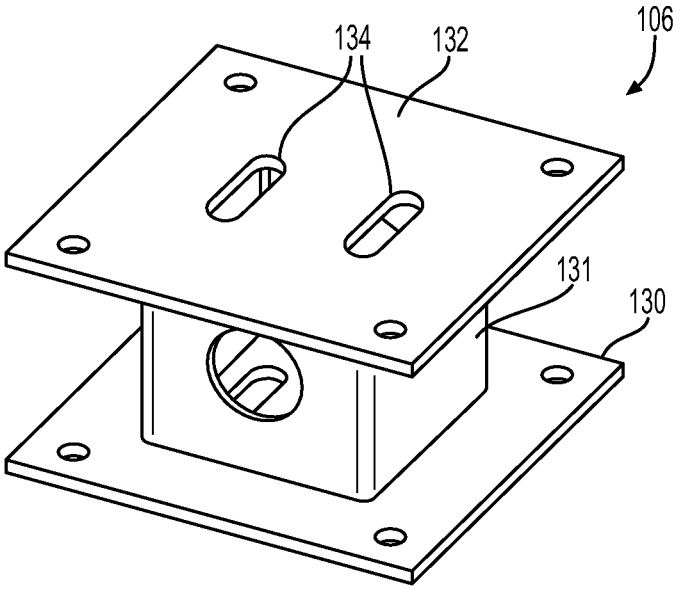

With reference to FIG. 18, the anchoring member 106 has lower and upper horizontal flanges 130, 132 spaced apart by a body 131. The upper horizontal flange 132 has openings 134 which are in the shape of a slot.

Figure 7:
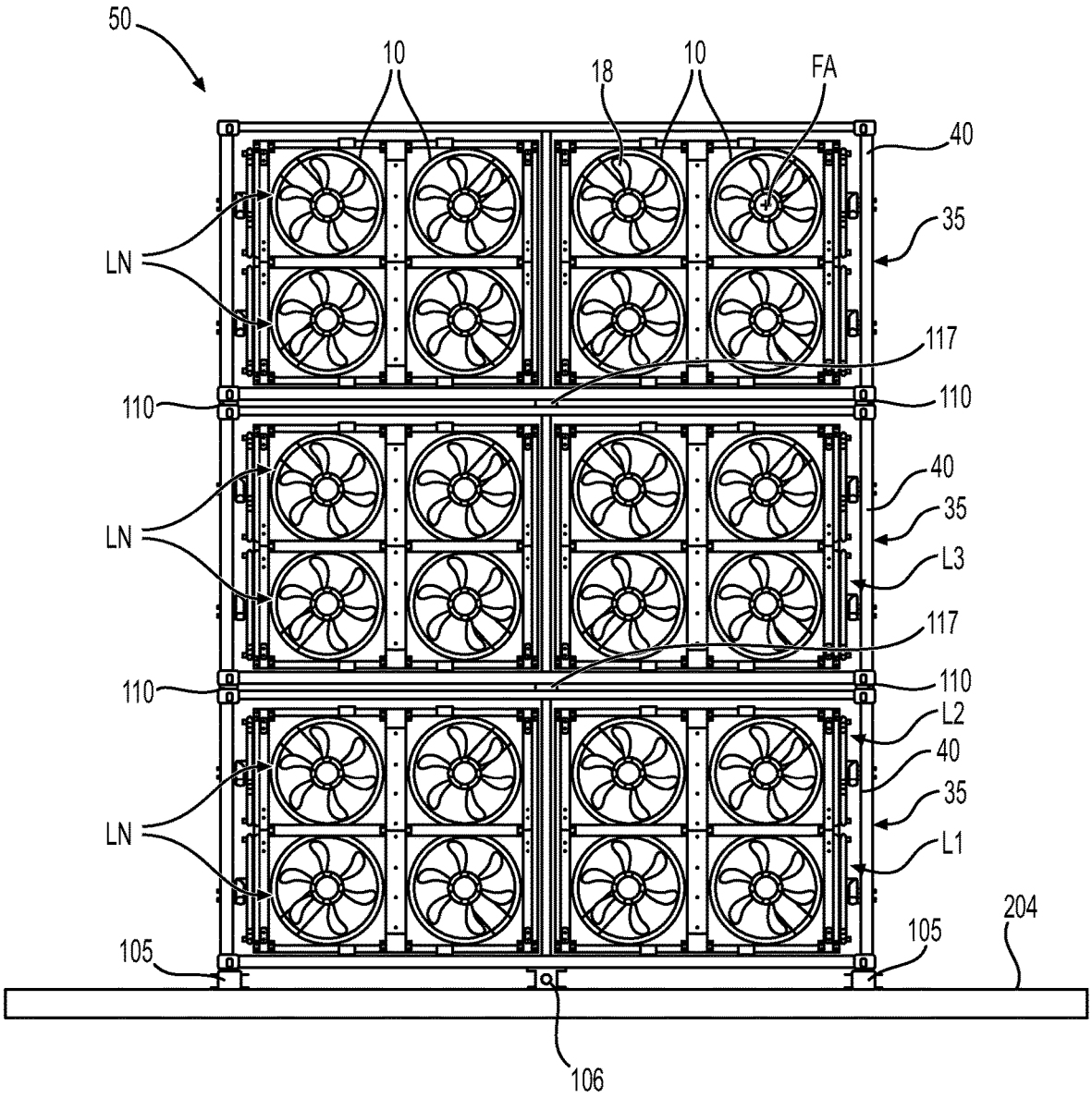
FIGS. 7 and 8 are front and side elevation views of a given dry cooler stack of the cooling assembly of FIG. 2.

The anchoring members 105, 106 are affixed to the support surface 204 by fastening the anchoring members 105, 106 to the support surface via holes provided in their respective lower and upper horizontal flanges 120, 122, 130, 132. In this example, the anchoring members 105, 106 are bolted to the support surface 204 by providing bolts that traverse the openings in the lower and upper horizontal flanges 120, 122, 130, 132 of the anchoring members 105, 106. As shown in FIGS. 7 and 8, the anchoring members 105 are affixed to locations on the support surface 204 at which the corners of the bottommost stackable unit 35 are to be located, while the anchoring members 106 are affixed to locations on the support surface 204 at which middle junctions between the lower longitudinal members 42 and the middle vertical members 62 are to be located.

Once the anchoring members 105, 106 are affixed in place, the bottommost stackable unit 35 of each of the dry cooler stacks 50 is positioned atop its respective set of anchoring members 105, 106 and secured to the anchoring members 105, 106. In the case of the anchoring member 105, the top portion 125 is inserted into a corresponding one of the lower corner members 58 of the main frame 40 in its unlocked position and then the lever 128 is moved to cause the top portion 125 to rotate into its locked position. As for the anchoring member 106, the main frame 40 is fastened (e.g., bolted) to the flanges 130, 132 of the anchoring member 106 via the openings 134 provided in the flange 130 to that effect.

The anchoring members 105, 106 each have a height of approximately 30 cm to elevate the bottommost stackable units 35. This allows the piping 15 to run under the dry cooler stacks 50.

Figure 19:
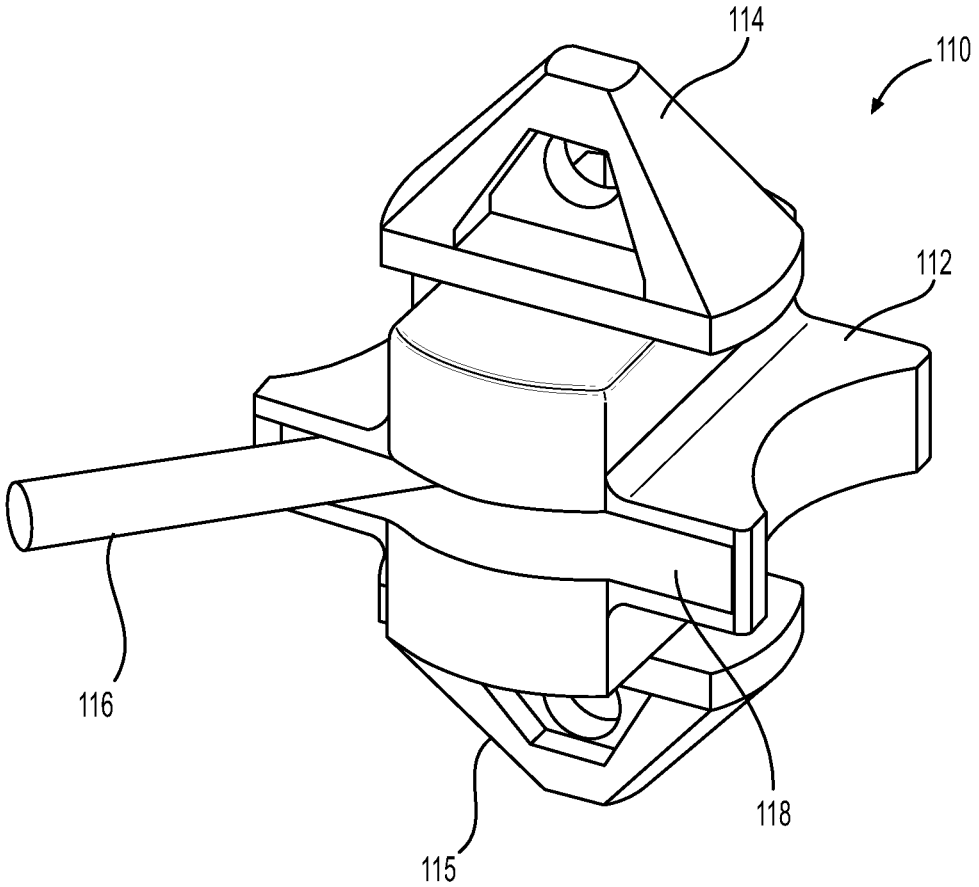
FIG. 19 is a perspective view of a securing device of the cooling assembly of FIG. 2.

With the bottommost stackable units 35 of the dry cooler stacks 50 anchored in place, the other stackable units 35 can then be stacked atop the bottommost stackable units 35. In order to securely stack the stackable units 35 atop one another, a plurality of securing devices 110 are provided. As shown in FIG. 19, each securing device 110 has a base portion 112, a top portion 114 extending upward from the base portion 112 and a bottom portion 115 extending downward from the base portion 112. The securing device 110 also has a selectively movable lever 116 that moves within a slot 118 of the base portion 112. Moving the lever 116 from one end of the slot 118 to the opposite end of the slot 118 actuates the top portion 114 of the securing device 110. More specifically, the top portion 114 rotates from an unlocked position (not shown) in which the top portion 114 is generally aligned with the base portion 112, to a locked position (see FIG. 19) in which the top portion 114 is generally perpendicular to the base portion 112. Such securing devices are known and commonly referred to as a "twistlock". The top portion 114 has a truncated pyramid shape and is thus pointed such that a length and width of the top portion 114 decreases upwardly towards an end of the top portion 114. The bottom portion 115 is shaped similarly to the top portion 114 such that a length and width of the bottom portion 115 decreases downwardly towards an end of the bottom portion 115.

Figure 4:
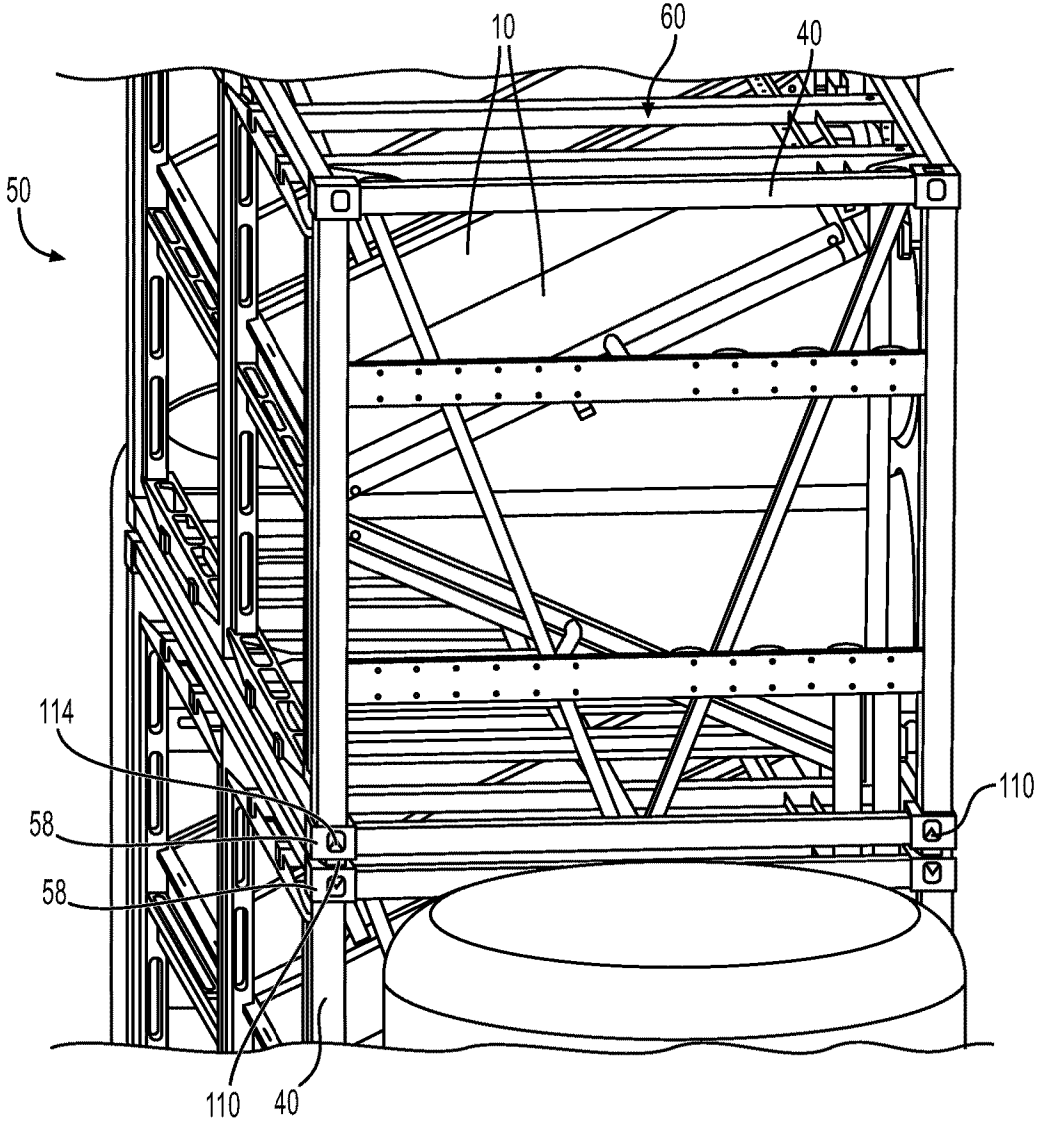
FIG. 4 is a detailed perspective view of part of the cooling assembly of FIG. 2.
Figure 10:
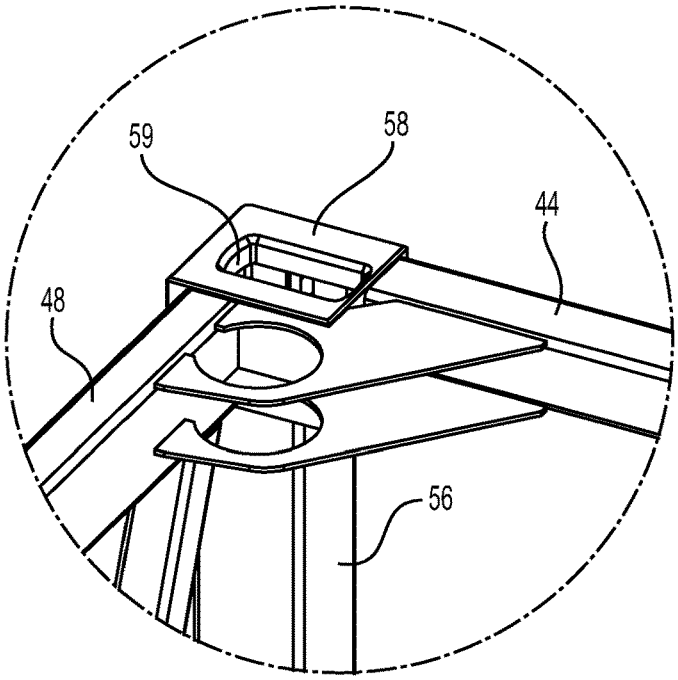
FIG. 10 is a perspective view of part of the frame of FIG. 9.

Prior to stacking a given one of the stackable units 35 atop another, the securing devices 110 are first affixed to the main frame 40 of the "bottom" stackable unit 35. In particular, with reference to FIG. 4, the securing devices 110 are affixed to each upper corner member 58 of the main frame 40 of the bottom stackable unit 35. More specifically, the bottom portion 115 of the securing device 110 is inserted into an opening 59 (see FIG. 10) of each upper corner member 58 such that the base portion 112 is abutted by the corner member 58. As shown in FIG. 7, in this example, a spacer 117 is also secured to the bottom stackable unit 35 at a middle portion thereof (e.g., adjacent the middle vertical members 62).

The "top" stackable unit 35 is then lifted (by a forklift or other suitable work vehicle) and stacked atop the bottom stackable unit 35 such that the top portion 114 of each of the securing devices 10 is received in the opening 59 of the lower corner members 58 and that the main frame 40 of the top stackable unit 35 is supported by the spacer 117. The lever 116 is then actuated to cause the top portion 114 to rotate into its locked position, thus securing the top stackable unit 35 to the bottom stackable unit 35. The main frame 40 may also be bolted to the spacer 117.

Figure 21:
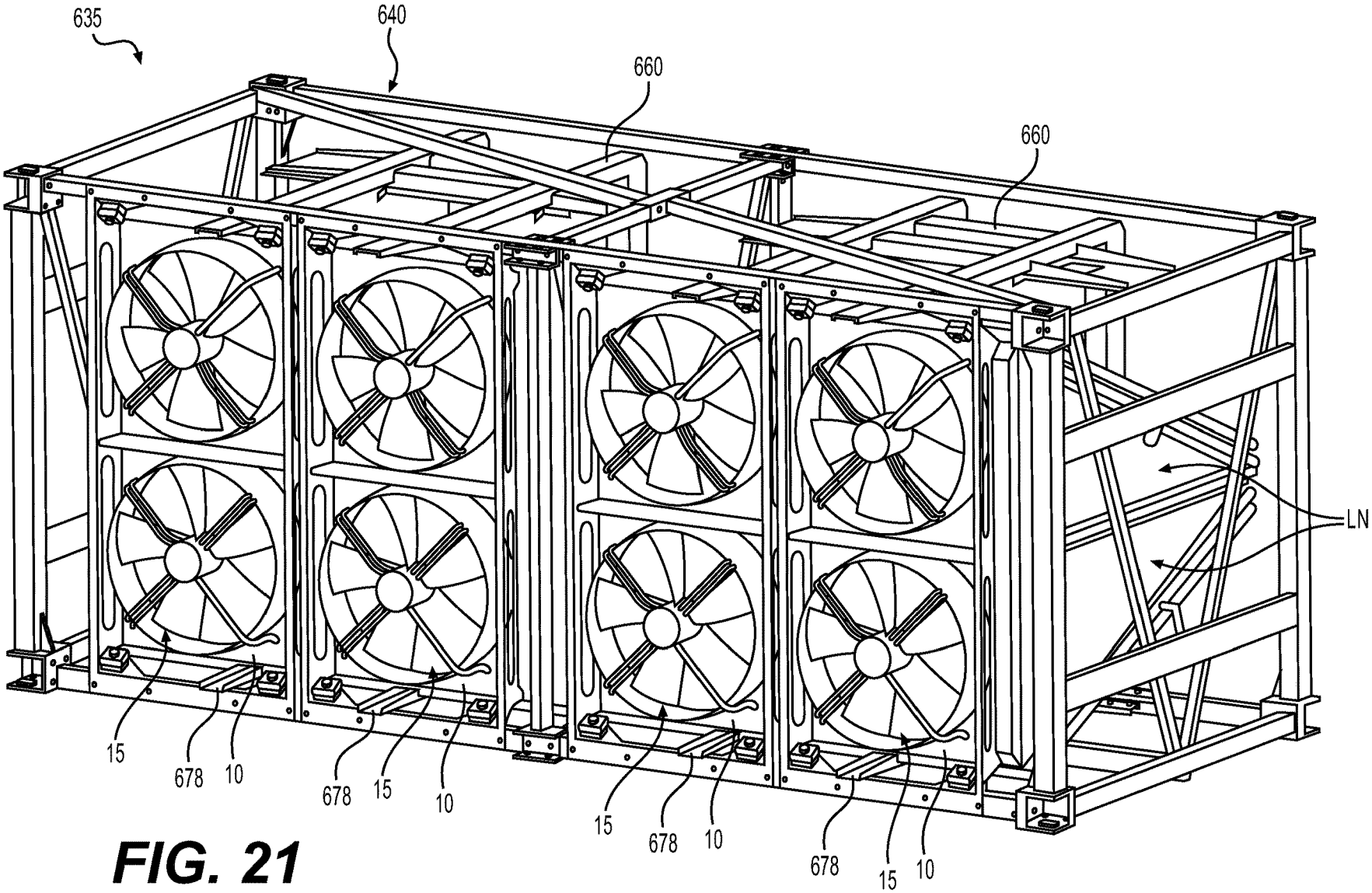
FIG. 21 is a perspective view of another embodiment of the stackable unit of FIG. 6.
Figure 22:
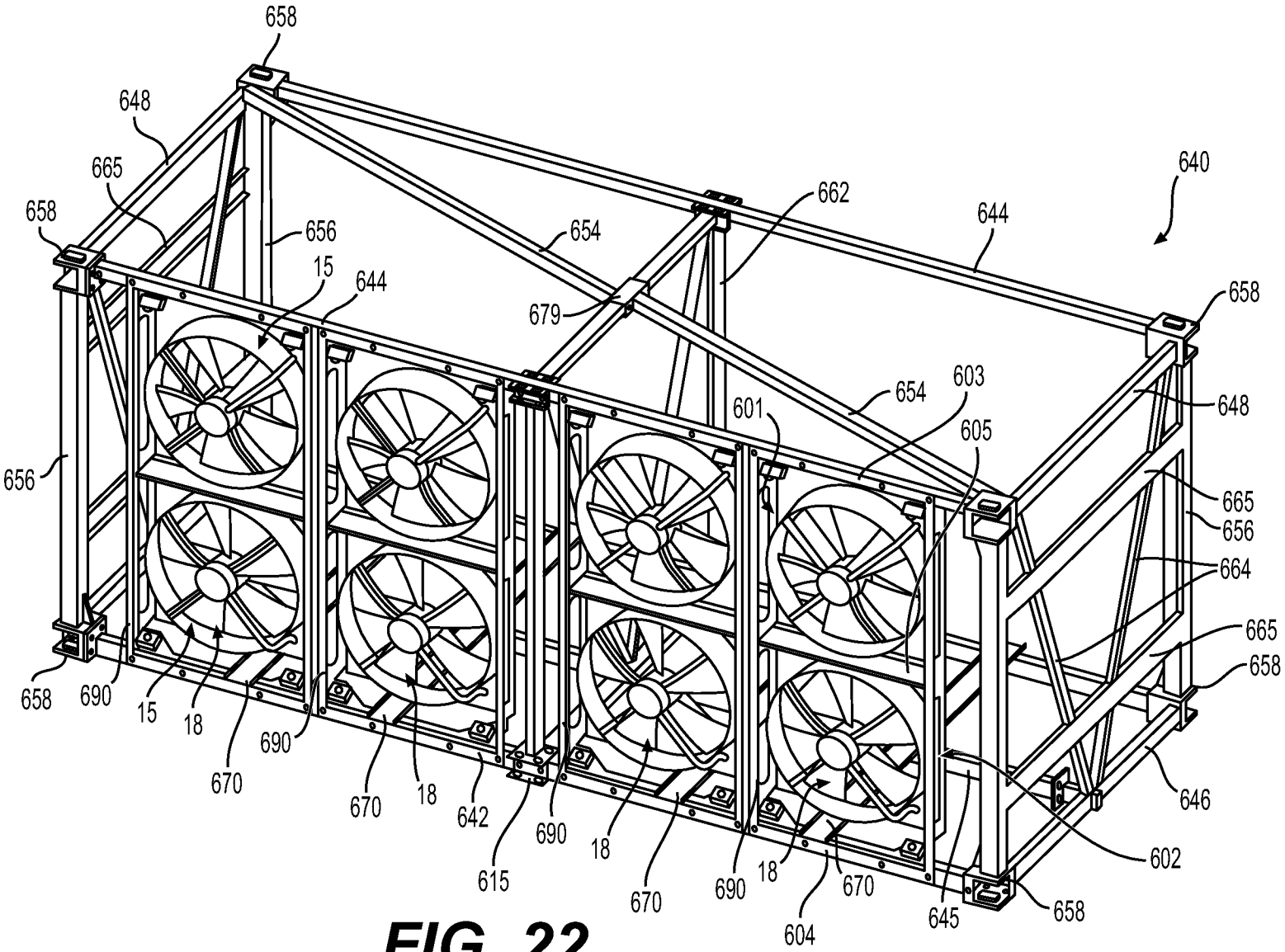
FIG. 22 is a perspective view of the frame of the stackable unit of FIG. 21.

An alternative embodiment of the stackable unit 35 is shown in FIG. 21. Notably, a stackable unit 635 is provided for forming the dry cooler stacks 50. The stackable unit 635 includes a main frame 640 and two dry cooler assemblies 660 that are slidably insertable into the main frame 640. The main frame 640 is substantially similar to the main frame 40 described above with similar members being given similar reference numbers. However, with reference to FIG. 22, in this alternative embodiment, the main frame 640 has four fan sub-frames 690 for mounting the fan assemblies 15 of the dry coolers 10 associated with the stackable unit 635. In particular, each fan sub-frame 690 is fastened to one of the lower longitudinal members 642 and a corresponding one of the upper longitudinal members 644 disposed above the lower longitudinal member 642. Each fan sub-frame 690 has an upper fan mount 601 and a lower fan mount 602 for mounting the fan assemblies 15 of the corresponding ones of the dry coolers 10. The upper fan mount 601 includes an upper edge 603 for connecting the fan sub-frame 690 to the upper longitudinal member 644 while the lower fan mount 602 includes a lower edge 604 for connecting the fan sub-frame 690 to the lower longitudinal member 642. A dividing horizontal member 605 of the fan sub-frame 690 divides respective spaces defined by the upper and lower fan mounts 601, 602 within which the fans 18 are located. The integration of the fans 18 with the main frame 640 may allow decreasing a weight of the associated dry cooler assemblies 660.

Figure 24A:
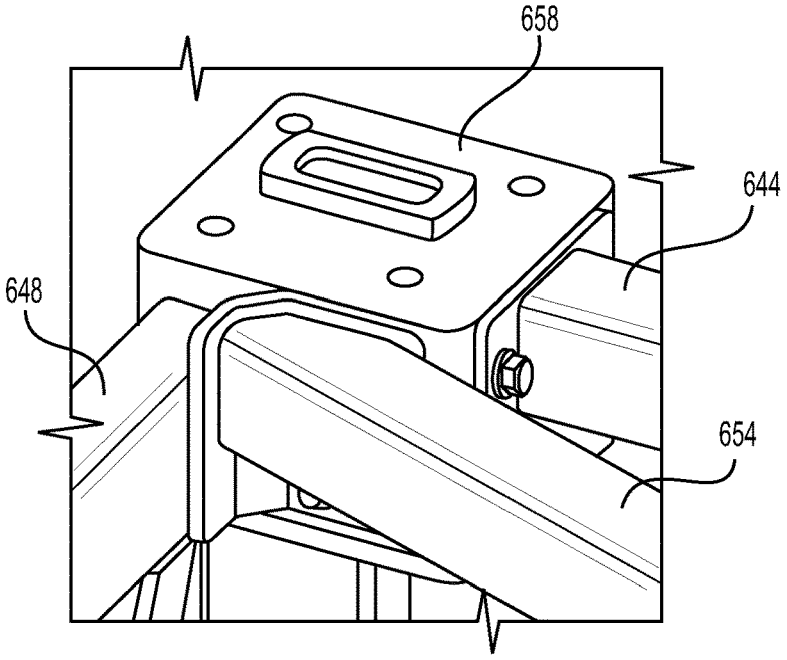
FIG. 24A is a perspective view of part of the frame of FIG. 22.
Figure 24B:
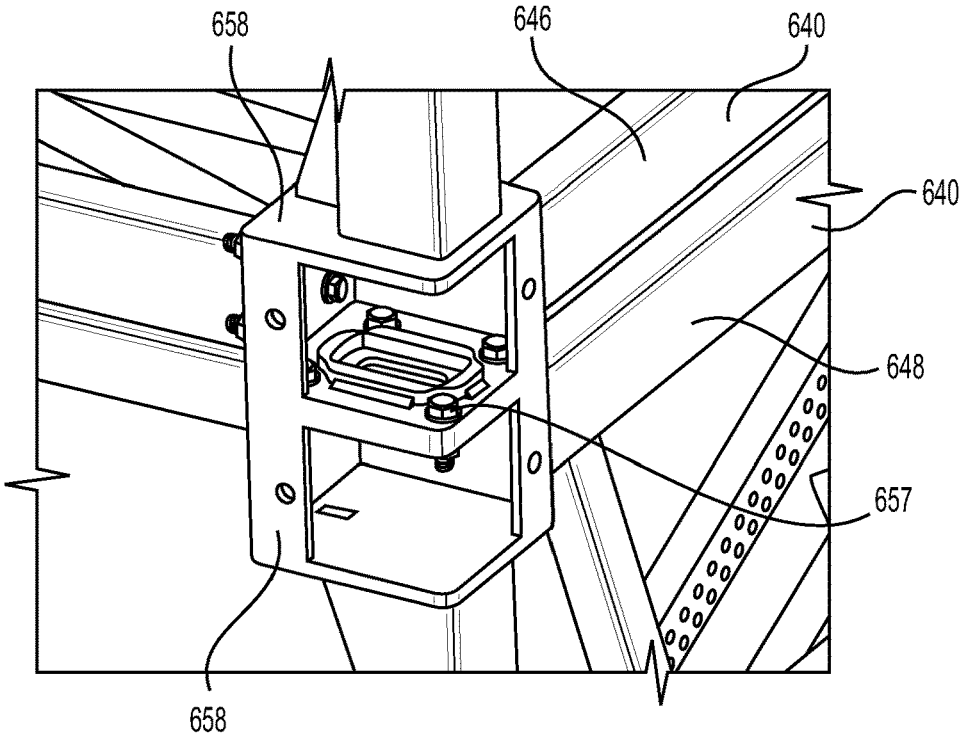
FIG. 24B shows part of two stackable units that are stacked atop one another according to the embodiment of FIG. 21.

The main frame 640 of the stackable unit 635 has upper diagonal members 654 that interconnect a given one of the corner members 658 at opposite ends of the main frame 640 to a sleeve member 679 connected to an upper middle member 667. More specifically, the sleeve member 679 is disposed at midlength of the upper middle member 667. Furthermore, corner members 658 of the main frame 640 are configured differently than corner members 58 described above. Notably, as shown in FIG. 24A, each of the upper corner member 658 is fastened (e.g., welded or bolted) to an upper end member 648, an upper longitudinal member 644 and (in the case of two of the upper corner members 658) one of the upper diagonal members 654. The upper corner members 658 each have a locating protrusion extending upwardly therefrom for engaging a lower corner member 658 of the main frame 640 of another stackable unit 635. More specifically, as shown in FIG. 24B, the lower corner member 658 has an opening for receiving therein the locating protrusion of the upper corner member 658. Moreover, the upper and lower corner members 658 are bolted to one another directly by fasteners 657. As such, the securing devices 110 are not used in this alternative embodiment. Similarly, a bracket 615 (FIG. 22) is provided on the lower longitudinal members 642 of the main frame 640, at midlength thereof (i.e., adjacent middle vertical members 662) for fastening two stackable units 635 to one another. Thus, the spacer 117 described above may not be used.

In addition, the various members of the main frame 640 are flanged at their end portions such as to be removably fastenable (e.g., with bolts) to other members of the main frame 640. This makes the main frame 640 demountable which may further facilitate its transport.

Figure 25:
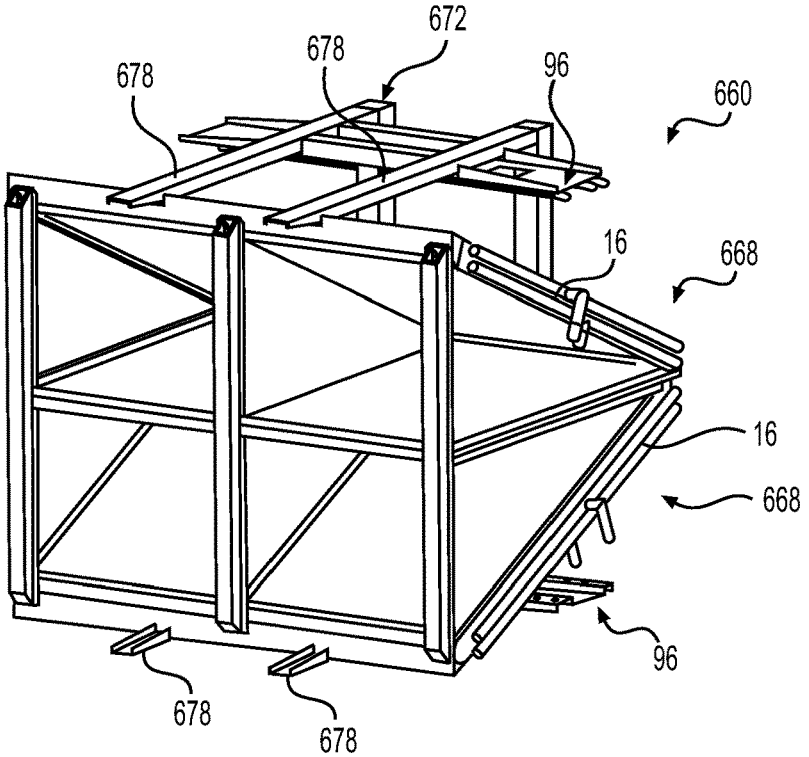
FIG. 25 is a perspective view of a given one of the dry cooler assemblies of FIG. 23.
Figure 26:
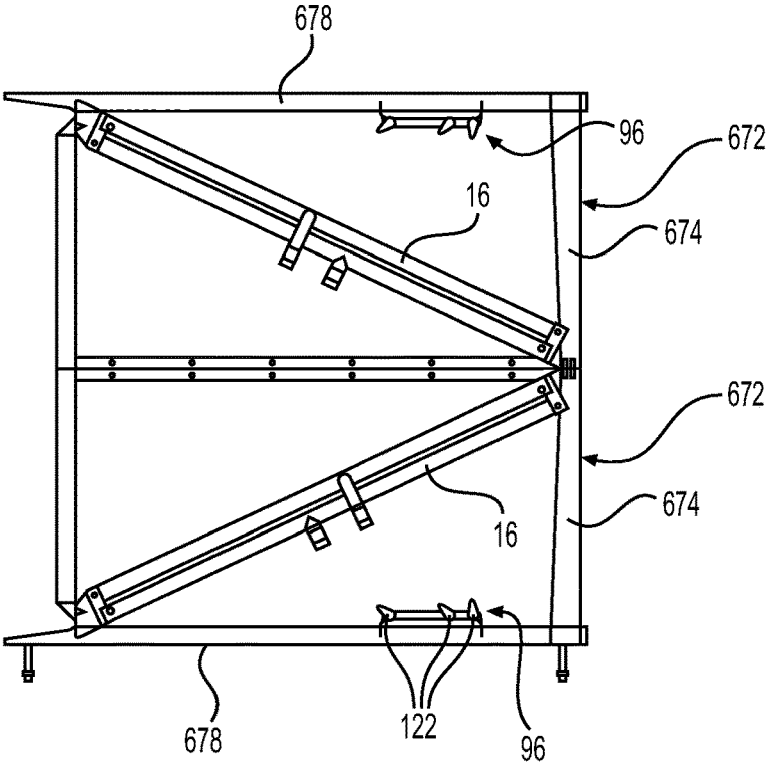
FIG. 26 is a side elevation view of the dry cooler assembly of FIG. 25.
Figure 27:
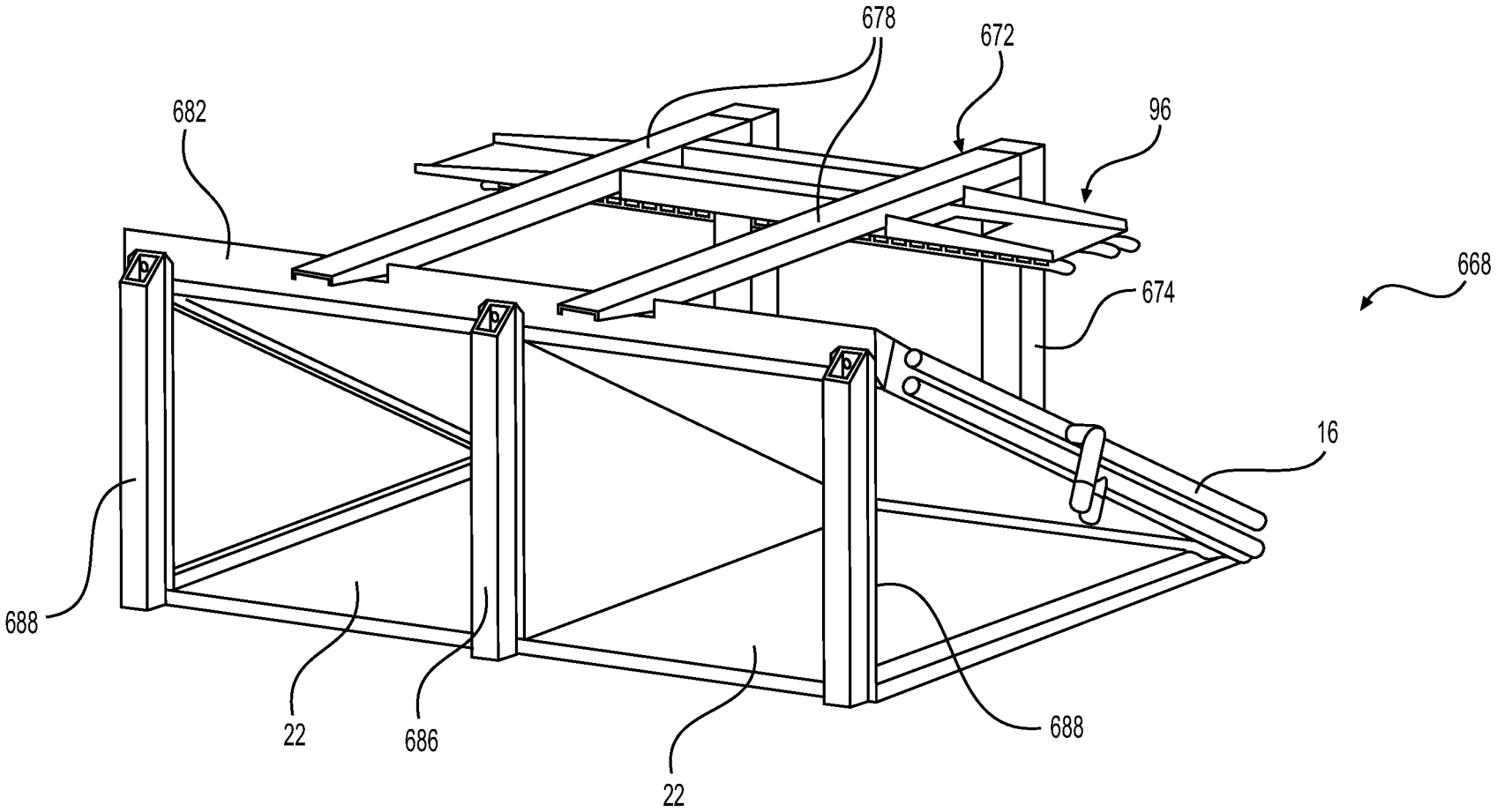
FIG. 27 is a perspective view of a discrete module of the dry cooler assembly of FIG. 26.
Figure 28:
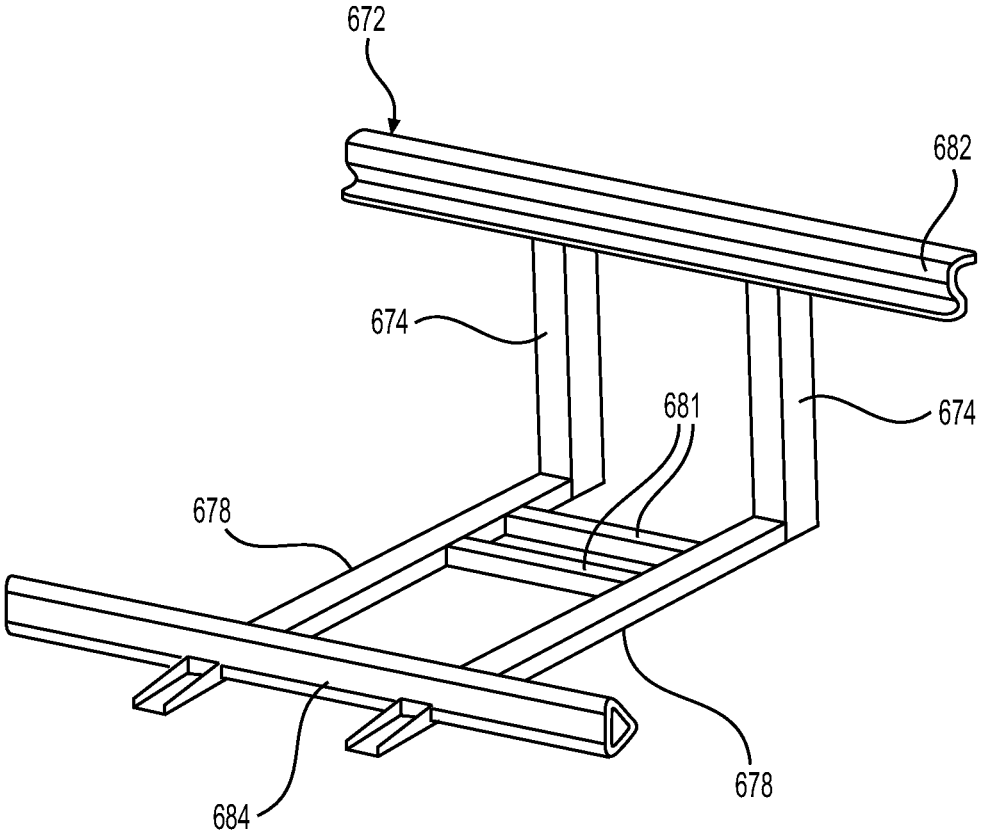
FIG. 28 is a perspective view of a sub-frame of the discrete module of FIG. 27.

As shown in FIGS. 25 to 27, the dry cooler assembly 660 forms part of four dry coolers 10, including two lower dry coolers 10 and two upper dry coolers 10. The dry cooler assembly 660 includes two discrete modules 668 that are connected to one another to form the dry cooler assembly 660. Each discrete module 668 forms, together with the fans 18 mounted to the main frame 40, two of the dry coolers 10 and has a sub-frame 672 for supporting the dry coolers 10. As shown in FIG. 28, the sub-frame 672 includes two legs 674 extending vertically and transverse member 682 interconnecting the legs 674 at one end of the legs 674. Lifting members 678 extend perpendicularly from an opposite end of the legs 674. The sub-frame 672 also includes an exchanger support member 684 that extends parallel to the transverse member 682 and interconnects the lifting members 678. The sub-frame 672 also includes two support members 681 that extend transversely to the legs 674 and are connected between the legs 674.

Figure 29:
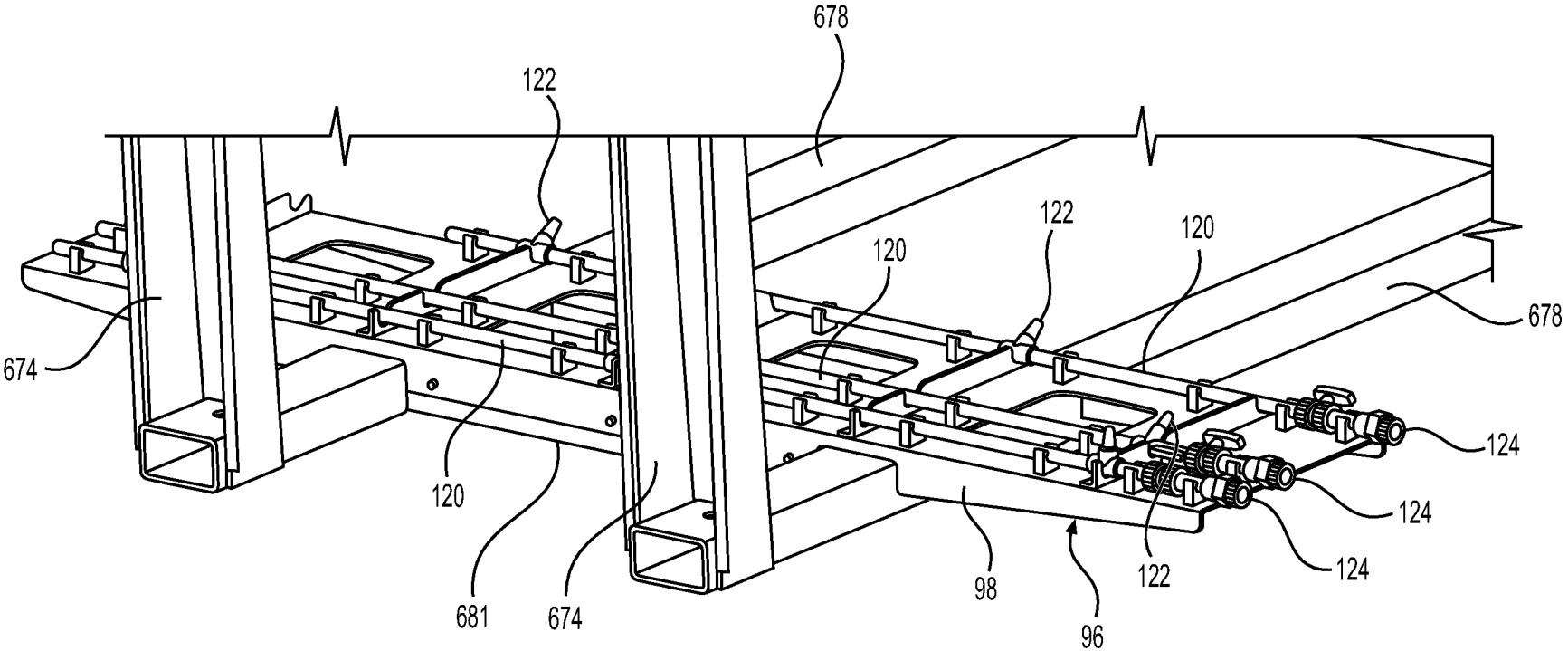
FIG. 29 shows an atomizer unit of the discrete module of FIG. 27.

Furthermore, as best shown in FIG. 29, each discrete module 668 includes an atomizer unit 96 configured to spray water in the direction of the heat exchanger panels 16 such as to cool the air flowing into the dry coolers 10. Each atomizer unit 96 has an atomizer support 98, a plurality of conduits 120 secured to the atomizer support 98 and nozzles 122 connected to the plurality of conduits 120. The atomizer support 98 is a plate that extends across and the lifting members 678 and is supported by the support members 681 of the corresponding discrete module 68. Each of the three conduits 120 has an intake 124 that is fluidly connected to a corresponding one of the tanks 80 such as to circulate fluid into the conduits 120. The nozzles 122 are thus generally pointed towards the heat exchanger panels 16 of the associated discrete module 68.

Figure 23:
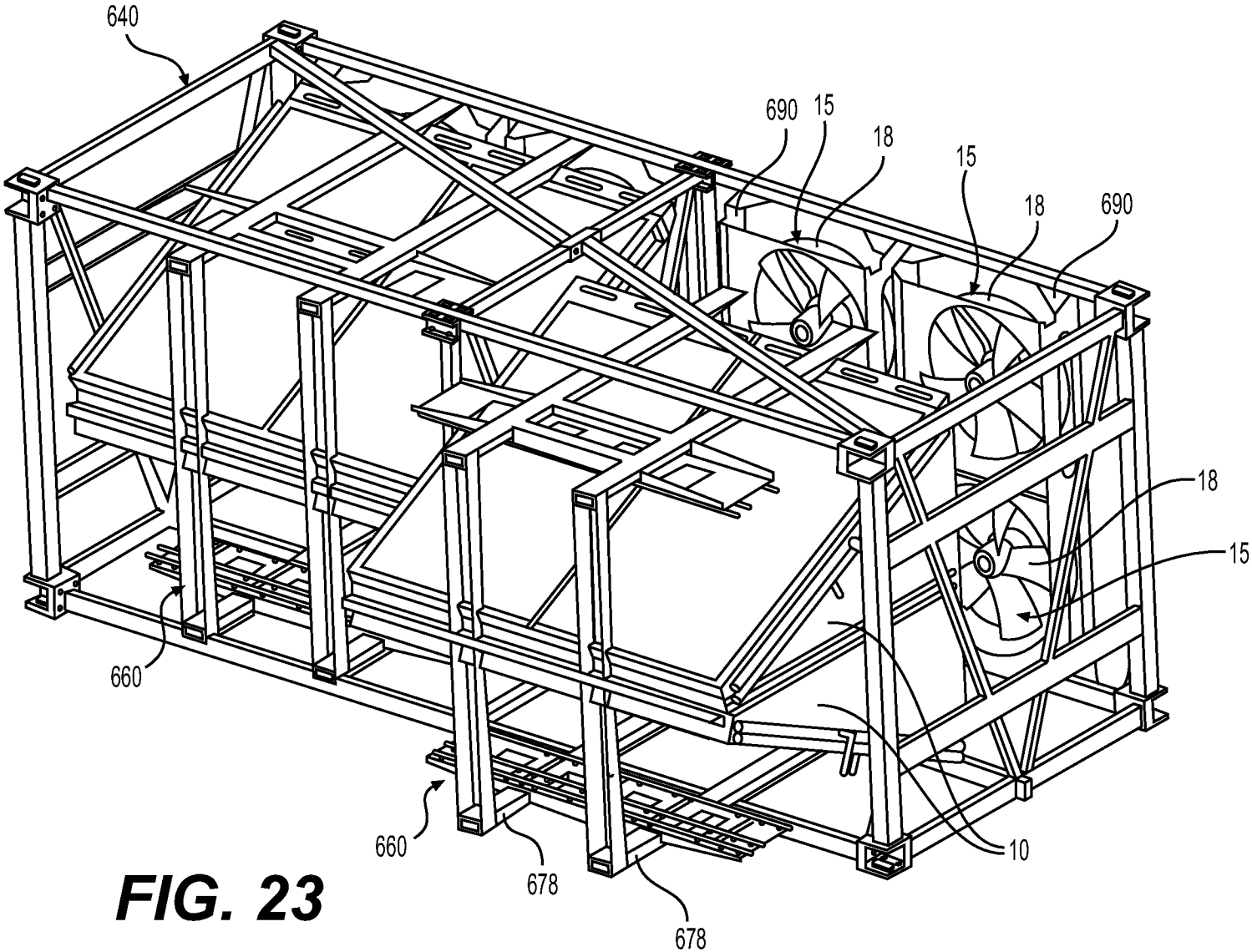
FIG. 23 is a perspective view of the stackable unit of FIG. 21 showing the dry cooler assembly being inserted into the frame of the stackable unit.

In this alternative embodiment, as shown in FIG. 23, the dry cooler assemblies 660 are slidably insertable into the main frame 40 of the stackable unit 635 such as to connect the dry cooler assemblies 660 with their respective fans 18 that are mounted to the main frame 40.

It is contemplated that various characteristics of the stackable unit 635, including those of its main frame 640 and dry cooler assemblies 660, could be integrated into the stackable unit 35 described above and vice-versa. For example, the dry cooler assemblies 60 could include the atomizer unit 96.

Figure 30:
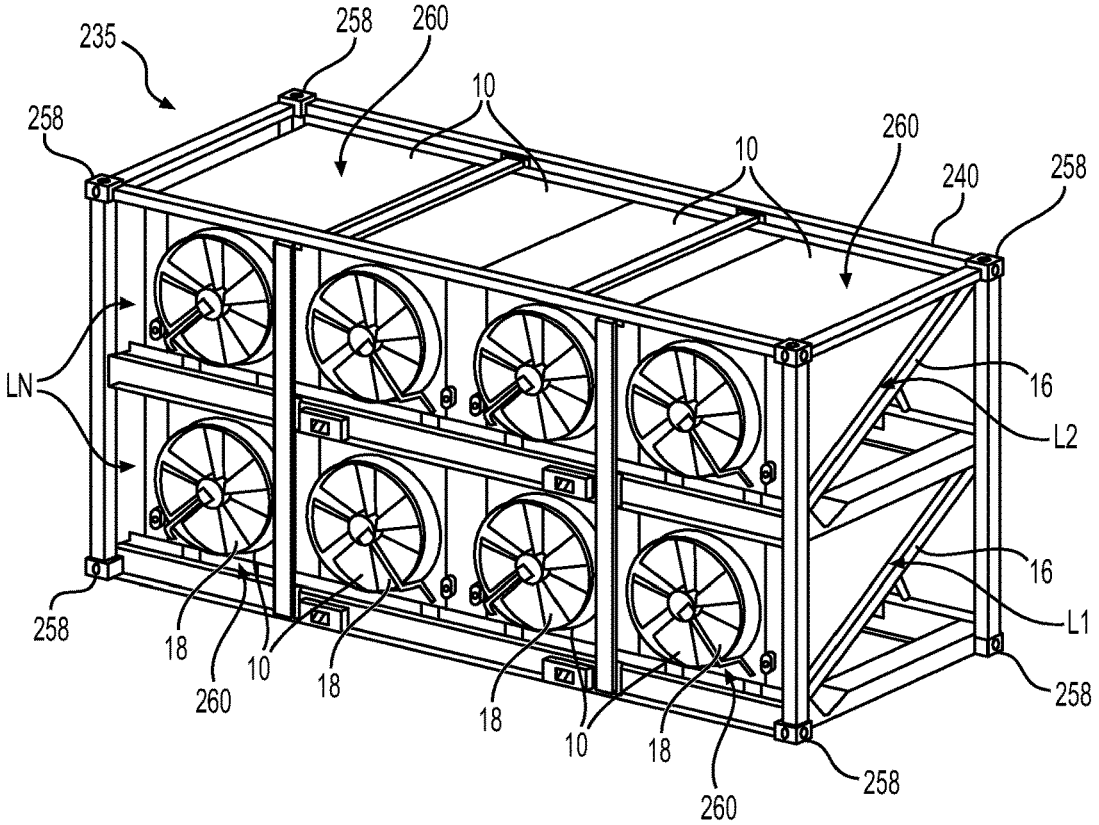
FIG. 30 is a perspective view of the stackable unit of FIG. 6 in accordance with a variant.
Figure 31:
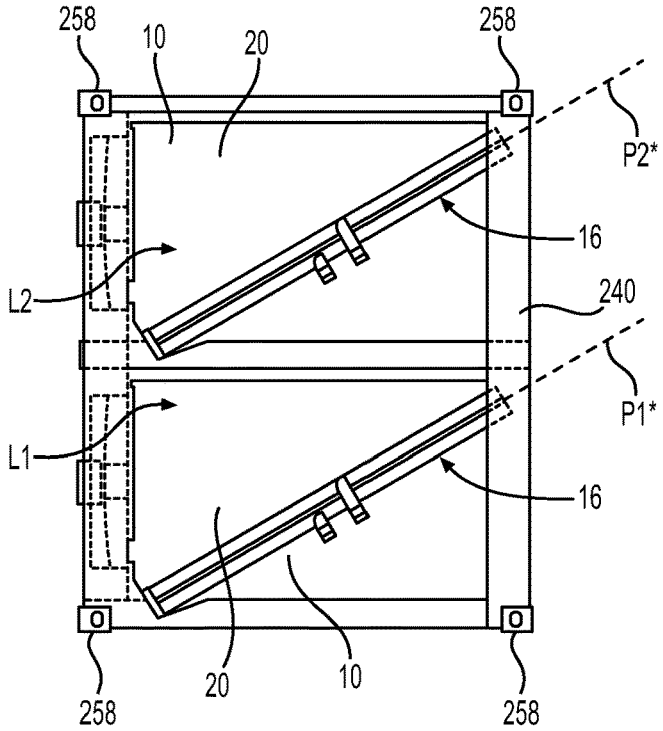
FIG. 31 is a side elevation view of the stackable unit of FIG. 30.
Figure 32:
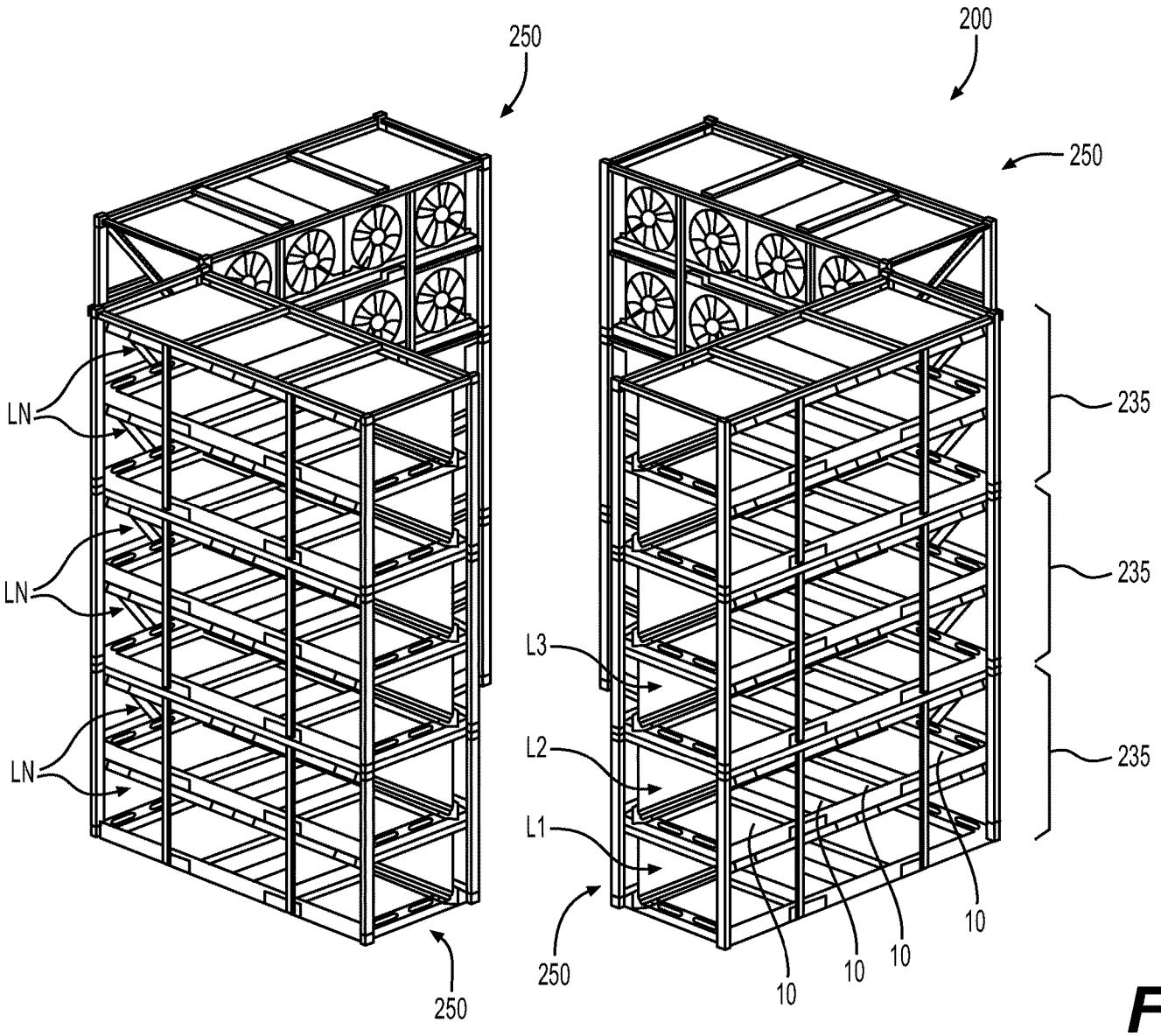
FIG. 32 is a perspective view of a cooling assembly implemented in accordance with the variant of the stackable unit of FIG. 19.

In a variant of the cooling assembly, as shown in FIGS. 30 to 32, a cooling assembly 200 is formed by dry cooler stacks 250. Each of the dry cooler stacks 250 includes a plurality of stackable units 235 stacked atop one another. Each of the stackable units 235 has a frame 240 similar to the frame 40 described above, notably including corner members 258 similar to the corner members 58.

As shown in FIG. 31, the heat exchanger panel 16 of each of the dry coolers 10 of the "lower" level L1 extends along a plane P1* that is parallel to a plane P2* along which the heat exchanger panel 16 of each of the dry coolers 10 of the "upper" level L2 extends. Moreover, as shown in FIG. 32, the heat exchanger panels 16 of each of the dry coolers 10 of a given dry cooler stack 250 extend along planes that are parallel to one another.

Each of the stackable units 235 includes a plurality of dry cooler assemblies 260. More particularly, in this example, each of the stackable units 235 includes four dry cooler assemblies 260. Each dry cooler assembly 260 includes two laterally-adjacent ones of the dry coolers 10. The dry cooler assemblies 260 are slidalby insertable into the frame 240 in a manner similar to that described above with respect to dry cooler assemblies 60.

Figure 33:
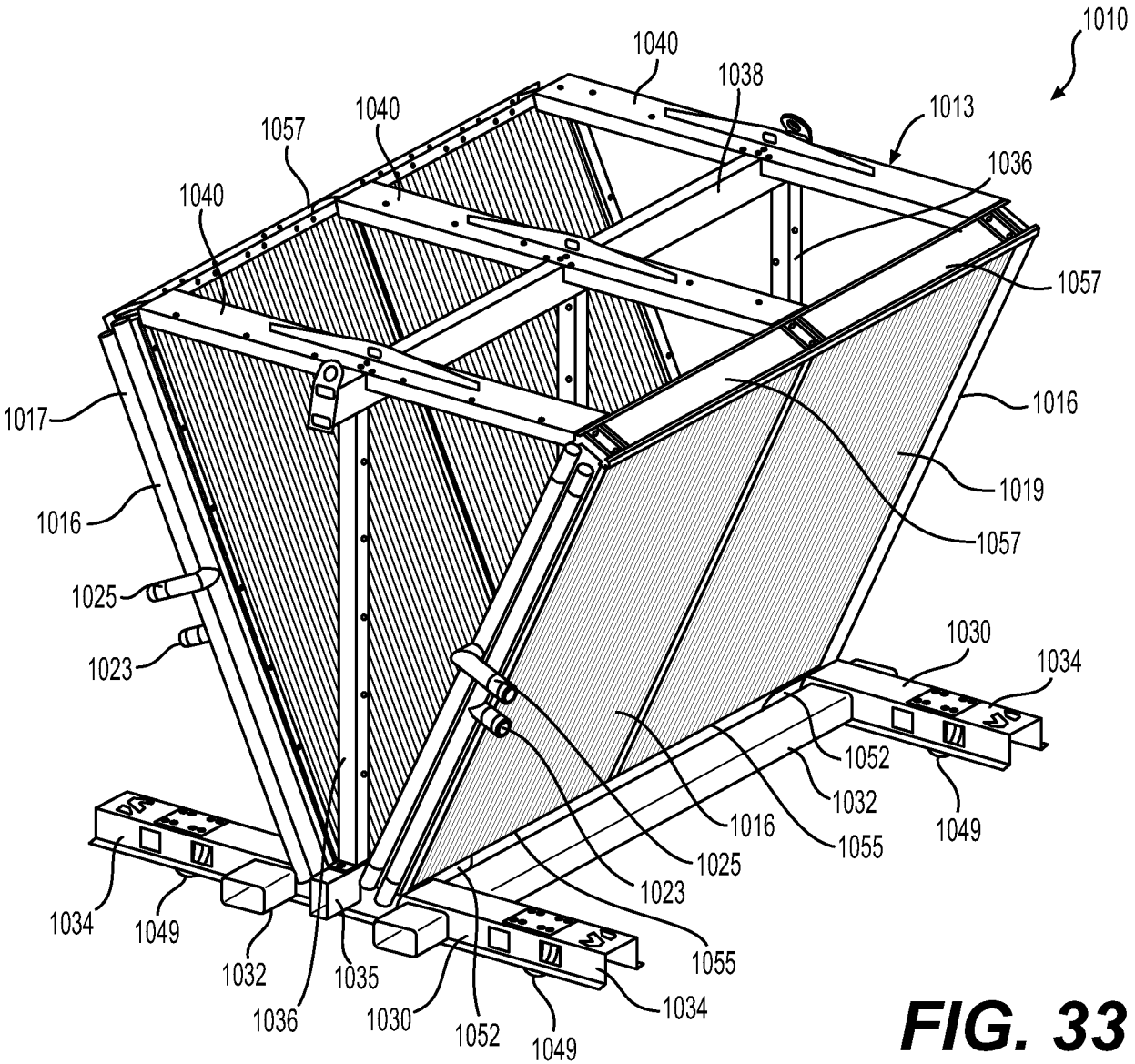
FIG. 33 is a perspective view of a dry cooler assembly in accordance with a variant, with certain components being removed to expose an underlying frame.

The dry cooler assemblies described above may be configured differently. For instance, FIG. 33 shows a dry cooler assembly 1010 (with the fans and enclosing panels removed therefrom to expose an underlying frame) in accordance with a variant. In this embodiment, the dry cooler assembly 1010 includes a frame 1013 for supporting the various components of the dry cooler assembly 1010. As will be described in greater detail below, the configuration of the frame 1013 may simplify the structure of the dry cooler assembly 1010 and total number of components thereof compared to conventional dry cooler assemblies.

Figure 34:
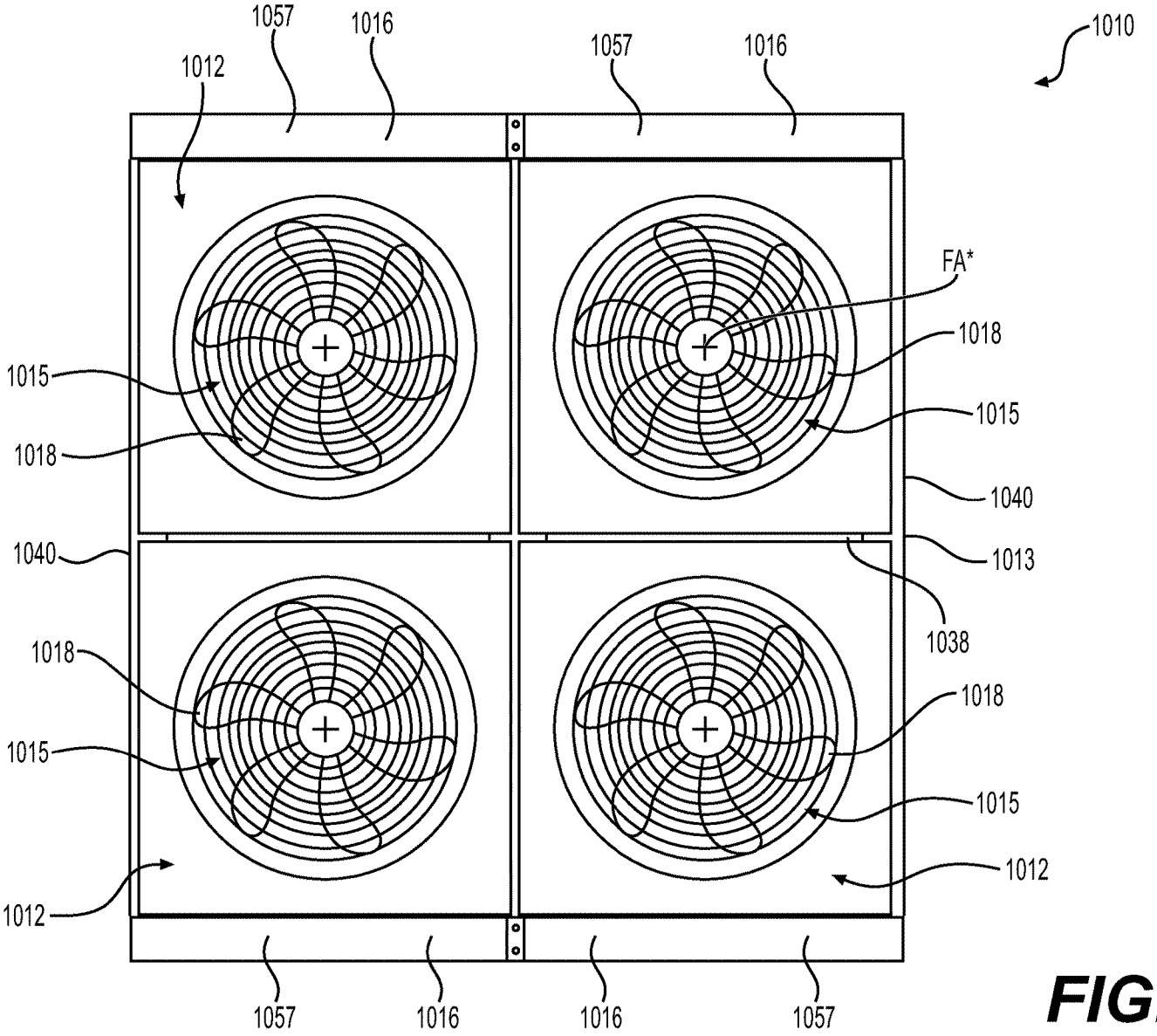
FIG. 34 is a top plan view of the dry cooler assembly of FIG. 33 including the fans of the dry coolers.
Figure 35:
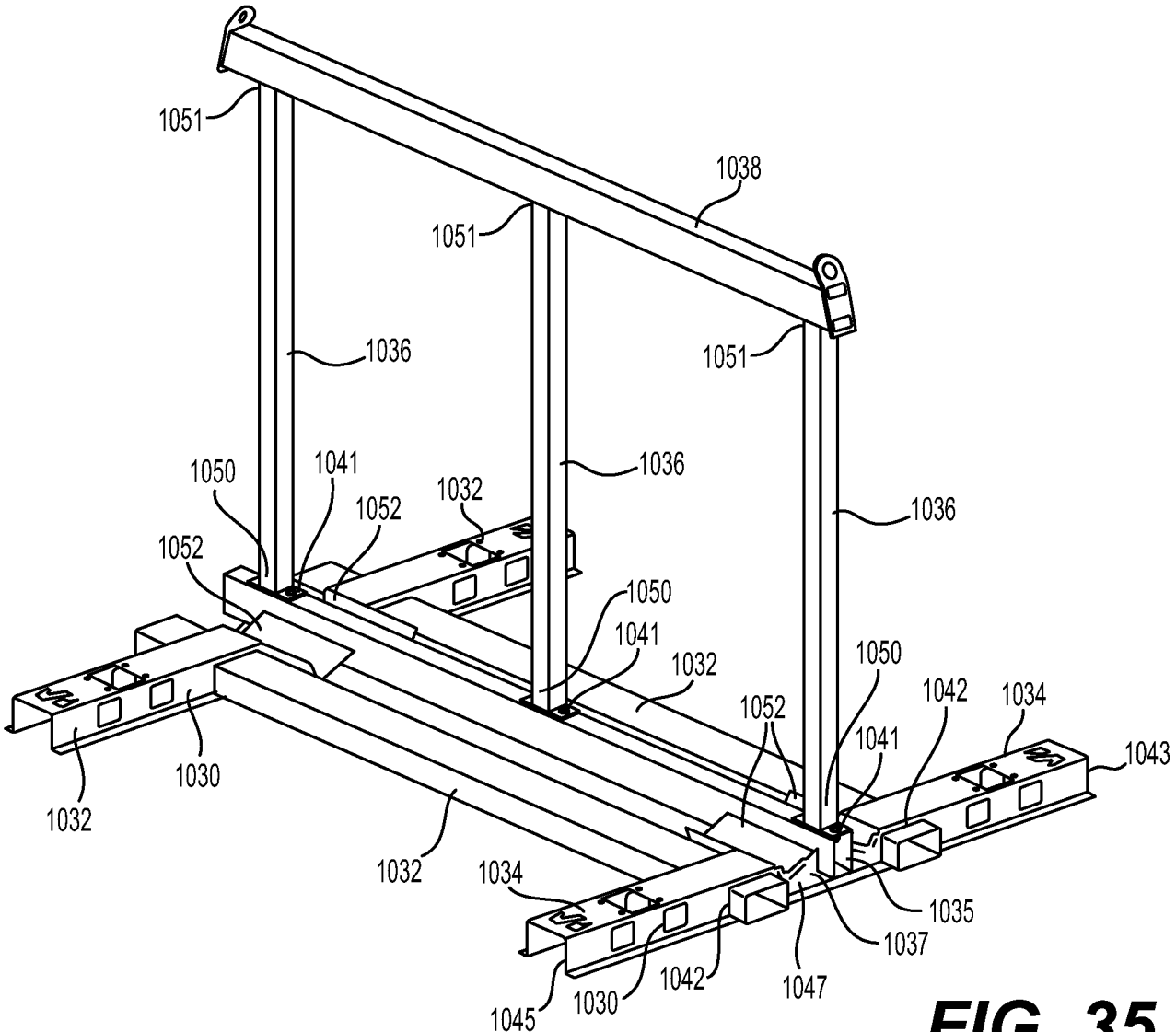
FIG. 35 is a perspective view of part of the frame of the dry cooler assembly.
Figure 36:
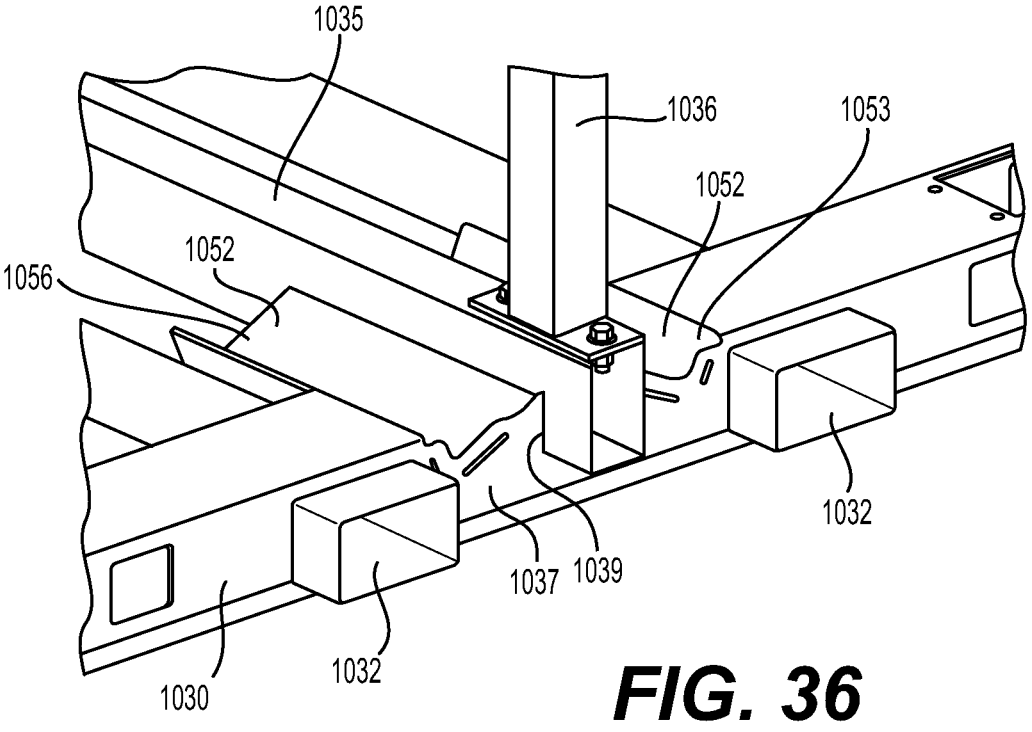
FIGS. 36 to 38 are detailed views of part of the frame of the dry cooler assembly.
Figure 37:
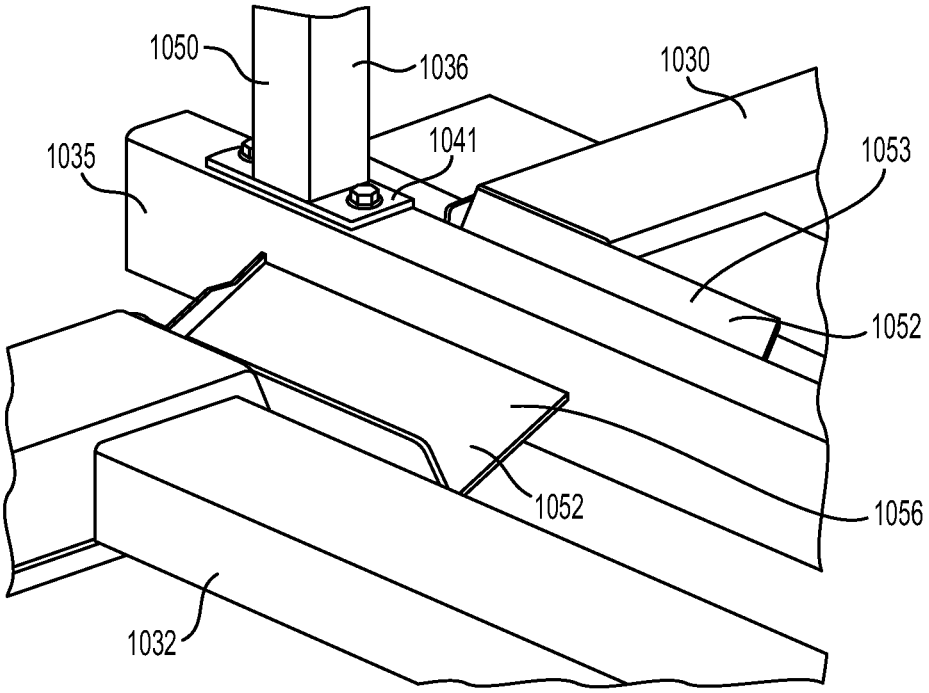
Figure 38:
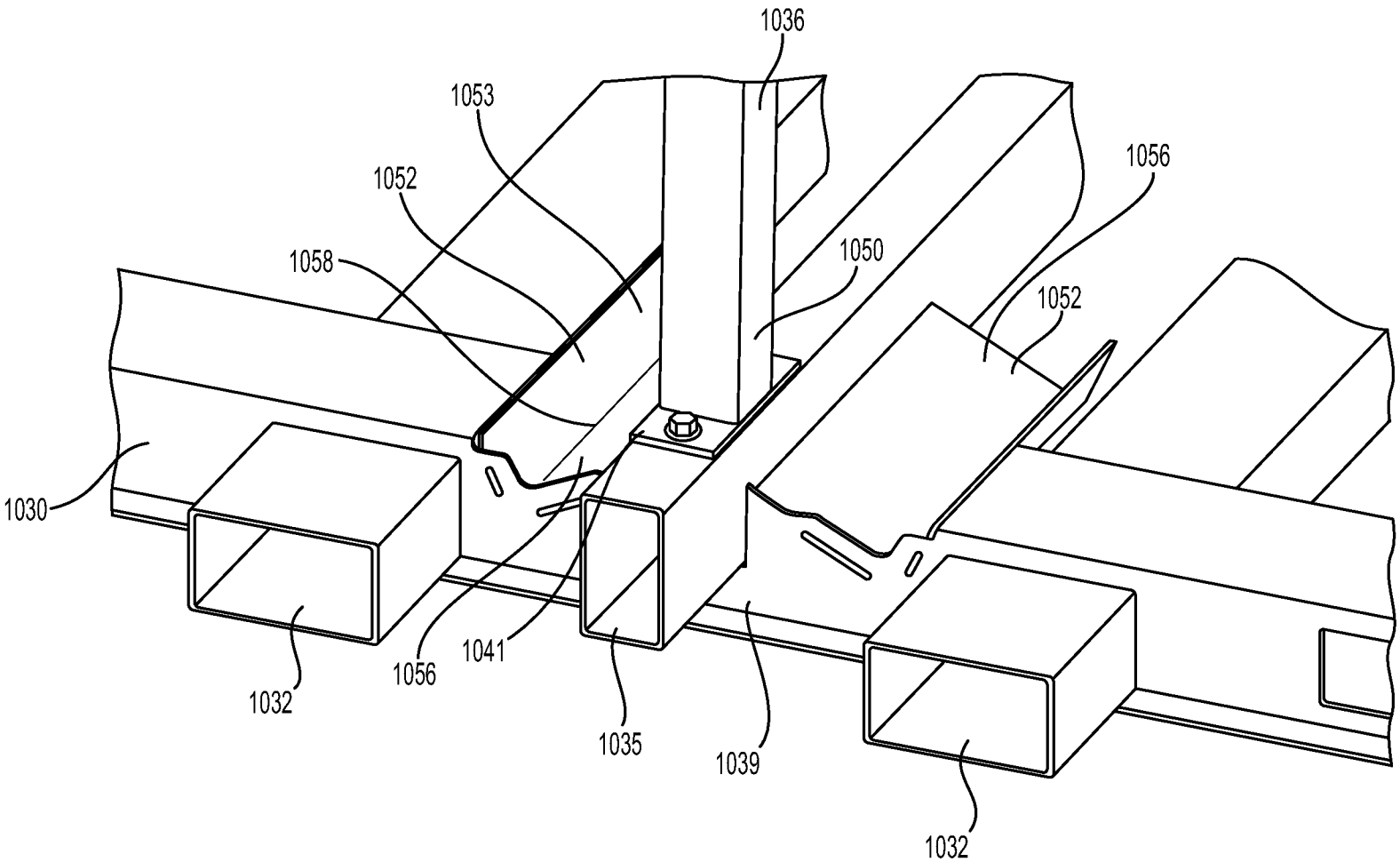

In this embodiment, the dry cooler assembly 1010 includes four dry coolers 1012, each defining an enclosed space within which air is pulled. Notably, as shown in FIG. 34, which depicts a top view of the dry cooler assembly 1010, each dry cooler 1012 has a fan assembly 1015 mounted to the frame 1013. The fan assembly 1015 includes a fan 1018 having a fan rotation axis FA* about which the fan 1018 rotates and a motor (not shown) for causing rotation of the fan 1018. Each dry cooler 1012 also has a heat exchanger panel 1016 mounted to the frame 1013 and configured for exchanging heat with air pulled into the dry cooler 1012 by the fan 1018. The heat exchanger panels 1016 are configured similarly to the heat exchanger panels 16 described above, notably including a tubing arrangement 1017 having a fluid intake 1023, a fluid outtake 1025 and a plurality of fins 1019 for facilitating heat exchange between fluid circulating in the tubing arrangement 1017 and air pulled into the dry cooler 1012. Each heat exchanger panel 1016 extends from a lower end 1055 to an upper end 1057 and is disposed in an inclined position relative to the fan rotation axis FA*. Longitudinally-adjacent ones of the heat exchanger panels 1016 are disposed in a V-configuration such that a distance between the upper ends 1057 of the longitudinally-adjacent ones of the heat exchanger panels 1016 is greater than a distance between the lower ends 1055 of the longitudinally-adjacent ones of the heat exchanger panels 1016. For instance, in this embodiment, the longitudinally-adjacent ones of the heat exchanger panels 1016 are oriented to form a 50° angle between them. The angle formed between the longitudinally-adjacent ones of the heat exchanger panels 1016 may have any other suitable value.

In this embodiment, the dry cooler assembly 1010 is configured to be "upright" such that the fan rotation axis FA* of each fan 1018 extends generally vertically (i.e., within 20° of a vertical orientation) relative to a support surface on which the dry cooler assembly 1010 is supported. As such, in this embodiment, the frame 1013 is configured to support the dry cooler assembly 1010 on a support surface (e.g., the surface of a roof). To that end, the frame 1013 has two legs 1030 laterally spaced apart from one another and which support the dry cooler assembly 1010 on the support surface. Each of the legs 1030 extends from a first end 1043 to a second end 1045 and has opposite end portions 1034 and a central portion 1039 between the end portions 1034. In this embodiment, the end portions 1034 of each of the legs 1030 has a U-shape cross-section while the central portion 1037 has a generally planar configuration forming a wall 1047 that extends along a plane extending vertically and parallel to the legs 1030. In this example, as shown in FIG. 33, the dry cooler assembly 1010 includes wheels 1049 (e.g., caster wheels) that are connected to the end portions 1034 of the legs 1030 such that the dry cooler assembly 1010 can be more easily displaced. For instance, this may facilitate moving the dry cooler assembly 1010 in/out of a container for transport.

Interconnecting the legs 1030 is a lower transversal member 1035 which extends laterally (i.e., transversally to the legs 1030). In this embodiment, the lower transversal member 1035 is centered between the ends 1043, 1045 of each of the legs 1030 and is thus connected to the central portion 1037 of each of the legs 1030. More specifically, in this example, the wall 1047 of each of the legs 1030 has a cut-out 1039 configured to support therein part of the lower transversal member 1030. To that end, the cut-out 1039 has a shape and dimensions similar to that of the lower transversal member 1035.

A pair of bracing members 1032 also extend laterally (i.e., parallel to and spaced apart from the lower transversal member 1035) to interconnect the legs 1030. More specifically, the end portions 1034 of each of the legs 1030 have a rectangular groove 1042 for receiving a respective one of the bracing members 1032. The bracing members 1032 may be connected to the legs 1030 in any suitable way. In this example, the bracing members 1032 are fastened (e.g., welded) to the legs 1030. The bracing members 1032 are positioned such that the lower transversal member 1035 is disposed between the bracing members 1032. The bracing members 1032 may be used to lift the dry cooler assembly 1010 via a forklift or other work vehicle, with the forks thereof being engaged within the cavity of each of the bracing members 1032.

A plurality of angular members 1052 are located between the legs 1030 and, as will be described in more detail below, are configured to support the heat exchanger panels 1016 of the dry cooler assembly 1010. In this embodiment, four angular members 1052 are provided, with each angular member 1052 being disposed between a respective one of the bracing members 1032 and the lower transversal member 1035 such that two of the angular members 1052 are located on one side of the lower transversal member 1035 while the other two angular members 1052 are located on the opposite side of the lower transversal member 1035. Moreover, in this embodiment, each of the angular members 1052 is connected to a respective one of the legs 1030 and to the lower transversal member 1035. It is contemplated that, in alternative embodiments, the angular members 1052 could be connected solely to the lower transversal member 1035.

The angular members 1052 have an angular configuration to conform to an angular shape of the lower ends 1055 of the heat exchanger panels 1016. Notably, each angular member 1052 includes two upwardly oriented faces 1053, 1056 that are transversal (e.g., perpendicular) to one another and converge at a junction 1058. In this embodiment, the angular member 1052 is a bent component such that the junction 1058 is a bend in the angular member 1052. The angular configuration of the angular members 1052 for conforming to an angular shape of the lower ends 1055 of the heat exchanger panels 1016.

The frame 1013 also has three upstanding members 1036 laterally spaced apart from one another and extending upwardly (e.g., vertically) from the lower transversal member 1035. Each of the upstanding members 1036 extends from a lower end portion 1050, that is connected to the lower transversal member 1035, to an upper end portion 1051. The upstanding members 1036 can be connected to the lower transversal member 1035 in any suitable way. In this embodiment, fasteners (e.g., bolts) fasten a flange 1041 at the lower end portion 1050 of each of the upstanding members 36 to the lower transversal member 1035. An upper transversal member 1038, disposed above the lower transversal member 1035, extends laterally (i.e., parallel to the lower transversal member 1035) to connect the upstanding members 1036 at their upper end portions 1051. The upper transversal member 1038 is connected to the upstanding members 1036 in any suitable way (e.g., welded).

Three upper retaining members 1040 extend transversally to the upper transversal member 1038 and parallel to the legs 1030. The upper retaining members 1040 are laterally spaced apart from one another and are connected to the upper transversal member 1038. More specifically, an underside of each of the upper retaining members 1040 has a cut-out of an appropriate shape and size for receiving part of the upper transversal member 1038.

In this embodiment, the lower transversal member 1035, the upstanding members 1036, the upper transversal member 1038 and the upper retaining members 1040 are elongated tubular members, defining an interior space therein. This may allow the frame 1013 to support a greater load than if the members were made of sheet metal as is typically the case in conventional dry cooler assemblies.

The dry cooler assembly 1010 also includes panels affixed to the frame 1013 and enclosing an interior space of each of the dry coolers 1012. While the panels are not shown in FIG. 33, the panels are understood to be similar to side panels 20, middle panel 21, and panels 22 described above with respect to the dry cooler assembly 60. Notably two middle panels similar to middle panel 21 are installed to divide the interior spaces of laterally-adjacent ones of the dry coolers 1012. It is understood that, in this embodiment, given the upright orientation of the dry cooler assembly 1010, the panels 22 would be vertically oriented (and would thus be referred to as a vertical panels rather than horizontal panels). In some embodiments, the dry cooler assembly 1010 may not include vertical panels to divide the interior space between opposite ones of the heat exchanger panels 1016 (i.e., the heat exchanger panels 1016 across from each other relative to the upstanding members 1036). In such embodiments, the dry cooler assembly 1010 may be considered to include two dry coolers 1012 subdivided by the middle panels that are generally aligned with the middle upstanding member 1036, and the dry cooler assembly 1010 may have two fan assemblies 1015 instead of four, with each fan assembly 1015 pulling air through two of the opposite ones of the heat exchanger panels 1016.

The upper end 1057 of each of the heat exchanger panels 1016 is connected to two adjacent ones of the upper retaining members 1040. In this example, the upper end 1057 of each of the heat exchanger panels 1016 is fastened to the corresponding ones of the upper retaining members 1040 via fasteners (e.g., bolts). In this embodiment, laterally-adjacent ones of the heat exchanger panels 1016 are connected at their lower ends 1055. Moreover, the lower end 1055 of each of the heat exchanger panels 1016 is supported by at least one of the angular members 1052 such that the lower end 1055 of each of the heat exchanger panels 1016 is disposed between the bracing members 1032. The lower end 1055 of each of the heat exchanger panels 1016 is fastened (e.g., bolted) to the angular members 1052.

This configuration of the dry cooler assembly 1010 may distribute a greater load on the upper end 1057 of the heat exchanger panel 1016. As such, other than the upstanding members 1036, the dry cooler assembly 1010 does not include vertical frame members to support the load of the dry cooler assembly 1010 as is typically found in conventional dry cooler assemblies. Thus, the dry cooler assembly 1010 may be lighter and consequently less expensive to produce than conventional dry cooler assemblies.

Moreover, the configuration of the dry cooler assembly 1010, notably lacking outer vertical support members to support the inclined heat exchanger panels 1016, may facilitate access to and removal of the heat exchanger panels 1016. For instance, a technician can remove the heat exchanger panels 1016 from outside of the dry cooler assembly 1010 without having to remove other panels or the fan assemblies 1015. That is, in order to remove any of the heat exchanger panels 1016, the technician unfastens the upper end 1057 of the heat exchanger panel 1016 from the corresponding retaining members 1040 and the lower end 1055 from the angular members 1052. The heat exchanger panel 1016 is unfastened from the adjacent heat exchanger panel 1016 if applicable and removed from the dry cooler assembly 1010.

It is contemplated that, in alternative embodiments, rather than having two laterally-adjacent ones of the heat exchanger panels 1016 (on each side of the lower transversal member 1035) secured to one another and/or the frame 1013, a single heat exchanger panel may be provided on each side of the lower transversal member 1035 such that laterally-adjacent ones of the fans 1018 pull air through the single heat exchanger panel.

While the dry cooler assembly 1010 is described and shown as being oriented such that the fan rotation axes FA* of the fans 1018 are generally vertical, it is contemplated that the dry cooler assembly 1010 could, in alternative embodiments, be oriented such that the fan rotation axes FA* are generally horizontal or otherwise substantially transversal to a vertical axis in the same manner as the dry cooler assembly 60 described above.

Furthermore, while the dry cooler assembly 1010 includes dry coolers, it is understood that a similar structure can be implemented for other types of heat exchanger assemblies (e.g., a condenser).

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A heat exchanger assembly, comprising:

a frame comprising:

a first leg and a second leg laterally spaced apart from the first leg;

a lower transversal member extending laterally and interconnecting the first and second legs;

a first upstanding member and a second upstanding member laterally spaced apart from the first upstanding member, the first and second upstanding members extending upwardly from the lower transversal member;

an upper transversal member extending laterally and disposed above the lower transversal member, the upper transversal member being connected to the first and second upstanding members; and a first upper retaining member and a second upper retaining member laterally spaced apart from the first upper retaining member, the first and second upper retaining members being connected to the upper transversal member and extending transversally to the upper transversal member;

first and second heat exchanger panels for exchanging heat with air pulled into the heat exchanger assembly, each of the first and second heat exchanger panels extending from an upper end to a lower end and including a tubing arrangement for circulating fluid therein, wherein the upper end of the first heat exchanger panel is fastened by at least one first fastener to the first upper retaining member, wherein the upper end of the second heat exchanger panel is fastened by at least one second fastener to the second upper retaining member, the first and second heat exchanger panels being disposed in a V-configuration such that a distance between the upper ends of the first and second heat exchanger panels is greater than a distance between the lower ends of the first and second heat exchanger panels; and a fan for pulling air into the heat exchanger assembly via at least one of the first and second heat exchanger panels, the fan having a fan rotation axis extending generally parallel to the first and second upstanding members of the frame, wherein the frame further comprises a first angular member and a second angular member, wherein the first angular member is connected to the lower transversal member and the first heat exchanger panel, wherein the second angular member is connected to the lower transversal member and the second heat exchanger panel, and wherein the first angular member and the second angular member each have two faces that are perpendicular to one another and converge at a junction to form an angular shape that conforms to a corresponding angular shape of the lower ends of the first and second heat exchanger panels.

2. The heat exchanger assembly of claim 1, wherein:

the frame further comprises first and second bracing members extending laterally from the first leg to the second leg; and the lower ends of the first and second heat exchanger panels are disposed between the first and second bracing members.

3. The heat exchanger assembly of claim 1, wherein:

the first and second angular members support the lower end of a respective one of the first and second heat exchanger panels.

4. The heat exchanger assembly of claim 1, wherein:

the frame comprises a third upper retaining member laterally between and spaced apart from the first and second upper retaining members, the third upper retaining member being connected to the upper transversal member and extending transversally to the upper transversal member; and the upper end of each of the first and second heat exchanger panels is connected to the third upper retaining member.

5. The heat exchanger assembly of claim 1, further comprising a plurality of wheels affixed to the first and second legs.

6. The heat exchanger assembly of claim 1, wherein:

the fan is a first fan and the fan rotation axis is a first fan rotation axis;

the heat exchanger assembly comprises a second fan having a second fan rotation axis extending parallel to the first fan rotation axis;

the first fan is disposed adjacent the upper end of the first heat exchanger panel; and the second fan is disposed adjacent the upper end of the second heat exchanger panel.

7. The heat exchanger assembly of claim 1 being a dry cooler assembly.

8. The heat exchanger assembly of claim 1, wherein the first and second upstanding members extend vertically from the lower transversal member.

9. The heat exchanger assembly of claim 1, wherein the first and second upstanding members are tubular.

10. The heat exchanger assembly of claim 1, wherein the first and second upstanding members are elongated.

11. The heat exchanger assembly of claim 1, wherein each of the first and second upstanding members have a lower end portion and an upper end portion.

12. The heat exchanger assembly of claim 11, wherein the upper transversal member is connected to the first and second upstanding members at the upper end portions thereof.

13. The heat exchanger assembly of claim 1, further comprising a plurality of side panels connected to the frame to partially define an enclosed space of the heat exchanger assembly.

14. A heat exchanger assembly, comprising:

a frame comprising:

a first leg and a second leg laterally spaced apart from the first leg;

a lower transversal member extending laterally and interconnecting the first and second legs;

a first upstanding member and a second upstanding member laterally spaced apart from the first upstanding member, the first and second upstanding members extending upwardly from the lower transversal member;

an upper transversal member extending laterally and disposed above the lower transversal member, the upper transversal member being connected to the first and second upstanding members; and a first upper retaining member and a second upper retaining member laterally spaced apart from the first upper retaining member, the first and second upper retaining members being connected to the upper transversal member and extending transversally to the upper transversal member;

a first heat exchanger panel and a second heat exchanger panel, each of the first and second heat exchanger panels including a tubing arrangement for circulating fluid therein, wherein an upper end of the first heat exchanger panel is connected to the first upper retaining member, wherein an upper end of the second heat exchanger panel is connected to the second upper retaining member, and wherein a distance between the upper ends of the first and second heat exchanger panels is greater than a distance between lower ends of the first and second heat exchanger panels; and a fan for pulling air into the heat exchanger assembly via at least one of the first and second heat exchanger panels, wherein the frame further comprises a first angular member and a second angular member, wherein the first angular member is connected to the lower transversal member and the first heat exchanger panel, wherein the second angular member is connected to the lower transversal member and the second heat exchanger panel, and wherein the first angular member and the second angular member each have two faces that are perpendicular to one another and converge at a junction to form an angular shape that conforms to a corresponding angular shape of the lower ends of the first and second heat exchanger panels.

* * * * *